US009770058B2

(12) United States Patent
Angadjivand et al.

(10) Patent No.: US 9,770,058 B2
(45) **Date of Patent: *Sep. 26, 2017**

(54) FLAT-FOLD RESPIRATOR WITH MONOCOMPONENT FILTRATION/STIFFENING MONOLAYER

(75) Inventors: Seyed A. Angadjivand, Woodbury, MN (US); James E. Springett, Hudson, WI (US); John M. Brandner, St. Paul, MN (US); Marvin E. Jones, Grant, MN (US); Andrew R. Fox, Oakdale, MN (US); Michael R. Berrigan, Oakdale, MN (US); John D. Stelter, St. Joseph Township, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 808 days.

This patent is subject to a terminal disclaimer.

(21) Appl. No.: 11/693,186

(22) Filed: Mar. 29, 2007

(65) Prior Publication Data

US 2008/0011303 A1 Jan. 17, 2008

Related U.S. Application Data

(63) Continuation-in-part of application No. 11/457,899, filed on Jul. 17, 2006, now abandoned, and a
(Continued)

(51) Int. Cl.
*A41D 13/11* (2006.01)
*D04H 3/16* (2006.01)
(Continued)

(52) U.S. Cl.
CPC ..... *A41D 13/113* (2013.01); *A62B 23/025* (2013.01); *D04H 3/14* (2013.01); *D04H 3/16* (2013.01)

(58) Field of Classification Search
CPC .... A41D 13/113; A41D 13/11; A62B 23/025; D04H 3/14; D04H 3/16
(Continued)

(56) References Cited

U.S. PATENT DOCUMENTS 2,007,867 A 7/1935 Le Duc
2,265,529 A 12/1941 Kemp
(Continued)

FOREIGN PATENT DOCUMENTS

EP 0121299 10/1984
EP 0121299 A2 10/1984
(Continued)

OTHER PUBLICATIONS

Leiberman and Stewart, "Polypropylene Polymers" published in the Encyclopedia of Polymer Science and Technology, p. 297-298, online posting Oct. 15, 2004.*
(Continued)

*Primary Examiner* — Jennifer A Steele

(57) ABSTRACT

A flat-fold respirator is made from a stiff filtration panel joined to the remainder of the respirator through at least one line of demarcation. The panel contains a porous monocomponent monolayer nonwoven web that contains charged intermingled continuous monocomponent polymeric fibers of the same polymeric composition and that has sufficient basis weight or inter-fiber bonding so that the web exhibits a Gurley Stiffness greater than 200 mg and the respirator exhibits less than 20 mm $H_2O$ pressure drop. The respirator may be formed without requiring additional stiffening layers, bicomponent fibers, or other reinforcement and can be flat-folded for storage. Scrap from the manufacturing process may be recycled to make additional stiff filtration panel web.

19 Claims, 8 Drawing Sheets

Related U.S. Application Data continuation-in-part of application No. 11/457,906, filed on Jul. 17, 2006, now abandoned, and a continuation-in-part of application No. 11/461,128, filed on Jul. 31, 2006, now Pat. No. 7,905,973, and a continuation-in-part of application No. 11/461,136, filed on Jul. 31, 2006, now Pat. No. 7,902,096, and a continuation-in-part of application No. 11/461,145, filed on Jul. 31, 2006, now Pat. No. 7,858,163, and a continuation-in-part of application No. 11/461,192, filed on Jul. 31, 2006, now Pat. No. 7,807,591, and a continuation-in-part of application No. 11/461,201, filed on Jul. 31, 2006, now Pat. No. 9,139,940.

(51) Int. Cl.
*D04H 3/14* (2012.01)
*A62B 23/02* (2006.01)

(58) Field of Classification Search
USPC ..... 442/334, 340, 344, 400, 401; 128/205.29–206.24
See application file for complete search history.

(56) References Cited

U.S. PATENT DOCUMENTS

| | | | |
|---|---|---|---|
| 2,565,124 | A | 12/1951 | Durborow |
| 2,634,724 | A | 4/1953 | Burns |
| 2,752,916 | A | 7/1956 | Haliczer |
| RE24,549 | E | 10/1958 | Haliczer |
| 3,613,678 | A | 10/1971 | Mayhew |
| 3,664,335 | A | 5/1972 | Boucher et al. |
| 3,715,251 | A | 2/1973 | Prentice |
| 3,736,928 | A | 6/1973 | Andersson et al. |
| 3,971,369 | A | 7/1976 | Aspelin et al. |
| 3,981,650 | A | 9/1976 | Page |
| 4,100,324 | A | 7/1978 | Anderson |
| 4,118,531 | A | 10/1978 | Hauser |
| 4,248,220 | A | 2/1981 | White |
| 4,300,549 | A | 11/1981 | Parker |
| 4,405,297 | A | 9/1983 | Appel et al. |
| 4,417,575 | A | 11/1983 | Hilton et al. |
| 4,419,993 | A | 12/1983 | Peterson |
| 4,419,994 | A | 12/1983 | Hilton |
| 4,536,440 | A | 8/1985 | Berg |
| 4,547,420 | A | 10/1985 | Krueger et al. |
| 4,588,537 | A | 5/1986 | Klasse et al. |
| 4,600,002 | A | 7/1986 | Maryyanek et al. |
| 4,714,647 | A | 12/1987 | Shipp, Jr. et al. |
| 4,729,371 | A | 3/1988 | Krueger et al. |
| 4,795,668 | A | 1/1989 | Krueger |
| 4,807,619 | A | 2/1989 | Dyrud et al. |
| 4,818,464 | A | 4/1989 | Lau |
| 4,920,960 | A | 5/1990 | Hubbard et al. |
| 4,931,355 | A | 6/1990 | Radwanski et al. |
| 4,988,560 | A | 1/1991 | Meyer et al. |
| 5,079,080 | A | 1/1992 | Schwarz |
| 5,082,720 | A | 1/1992 | Hayes |
| 5,227,107 | A | 7/1993 | Dickenson et al. |
| 5,307,796 | A | 5/1994 | Kronzer |
| 5,322,061 | A | 6/1994 | Brunson |
| 5,382,400 | A | 1/1995 | Pike et al. |
| 5,476,616 | A | 12/1995 | Schwarz |
| 5,496,507 | A | 3/1996 | Angadjivand |
| 5,532,050 | A | 7/1996 | Brooks |
| 5,575,874 | A | 11/1996 | Griesbach, III et al. |
| 5,582,907 | A | 12/1996 | Pall |
| 5,597,645 | A | 1/1997 | Pike et al. |
| 5,679,042 | A | 10/1997 | Varona |
| 5,679,379 | A | 10/1997 | Fabbricante et al. |
| 5,681,469 | A | 10/1997 | Barboza et al. |
| 5,685,757 | A | 11/1997 | Kirsch et al. |
| 5,695,376 | A | 12/1997 | Datta et al. |
| 5,701,892 | A | 12/1997 | Bledstein |
| 5,707,468 | A | 1/1998 | Arnold et al. |
| 5,709,735 | A | 1/1998 | Midkiff et al. |
| 5,717,991 | A | 2/1998 | Nozaki et al. |
| 5,721,180 | A | 2/1998 | Pike et al. |
| 5,724,964 | A | 3/1998 | Brunson et al. |
| 5,735,270 | A | 4/1998 | Bayer |
| 5,753,736 | A | 5/1998 | Bhat et al. |
| 5,817,584 | A | 10/1998 | Singer et al. |
| 5,877,098 | A | 3/1999 | Tanaka et al. |
| 5,902,540 | A | 5/1999 | Kwok |
| 5,904,298 | A | 5/1999 | Kwok et al. |
| 5,908,598 | A | 6/1999 | Rousseau et al. |
| 5,993,543 | A | 11/1999 | Aoki et al. |
| 5,993,943 | A | 11/1999 | Bodaghi et al. |
| 6,041,782 | A | 3/2000 | Angadjivand et al. |
| 6,102,039 | A | 8/2000 | Springett et al. |
| 6,123,077 | A | 9/2000 | Bostock et al. |
| 6,176,955 | B1 | 1/2001 | Haynes et al. |
| 6,183,670 | B1 | 2/2001 | Torobin et al. |
| 6,217,691 | B1 | 4/2001 | Vair, Jr. et al. |
| 6,230,901 | B1 | 5/2001 | Ogata et al. |
| 6,274,238 | B1 | 8/2001 | DeLucia |
| 6,315,806 | B1 | 11/2001 | Torobin et al. |
| 6,319,865 | B1 | 11/2001 | Mikami |
| 6,358,592 | B2 | 3/2002 | Vair, Jr. et al. |
| 6,394,090 | B1 * | 5/2002 | Chen et al. ..... 128/206.12 |
| 6,397,458 | B1 | 6/2002 | Jones et al. |
| 6,398,847 | B1 | 6/2002 | Jones et al. |
| 6,409,806 | B1 | 6/2002 | Jones et al. |
| 6,474,336 | B1 | 11/2002 | Wolfe |
| 6,562,112 | B2 | 5/2003 | Jones et al. |
| 6,607,624 | B2 | 8/2003 | Berrigan et al. |
| 6,660,210 | B2 | 12/2003 | Jones et al. |
| 6,667,254 | B1 | 12/2003 | Thompson et al. |
| 6,709,996 | B2 | 3/2004 | Mleziva et al. |
| 6,723,669 | B1 | 4/2004 | Clark et al. |
| 6,770,356 | B2 | 8/2004 | O'Donnell et al. |
| 6,783,574 | B1 * | 8/2004 | Angadjivand et al. ..... 96/15 |
| 6,827,764 | B2 | 12/2004 | Springett et al. |
| 6,858,297 | B1 * | 2/2005 | Shah et al. ..... 428/401 |
| 6,916,752 | B2 | 7/2005 | Berrigan et al. |
| 6,998,164 | B2 | 2/2006 | Neely et al. |
| 7,069,930 | B2 | 7/2006 | Bostock et al. |
| 7,258,758 | B2 | 8/2007 | Collier, IV et al. |
| 2003/0018310 | A1 | 1/2003 | Allen |
| 2003/0114066 | A1 | 6/2003 | Clark et al. |
| 2003/0134515 | A1 | 7/2003 | David et al. |
| 2003/0162457 | A1 | 8/2003 | Berrigan et al. |
| 2004/0097155 | A1 | 5/2004 | Olson et al. |
| 2004/0255946 | A1 * | 12/2004 | Gerson et al. ..... 128/205.27 |
| 2005/0217226 | A1 | 10/2005 | Sundet et al. |
| 2009/0315224 | A1 | 12/2009 | Angadjivand et al. |
| 2010/0258967 | A1 | 10/2010 | Fox et al. |
| 2011/0074060 | A1 | 3/2011 | Angadjivand et al. |

FOREIGN PATENT DOCUMENTS

| | | |
|---|---|---|
| EP | 0 322 136 B1 | 2/1994 |
| EP | 0799342 | 9/1999 |
| GB | 2 103 491 A | 2/1983 |
| GB | 2241896 | 9/1991 |
| JP | 61-103454 | 5/1986 |
| JP | 62-243568 | 10/1987 |
| JP | 1-321916 | 12/1989 |
| JP | 9-192248 | 10/1996 |
| JP | 2001-049560 | 2/2001 |
| JP | 2001-525201 | 12/2001 |
| JP | 2002-180331 | 6/2002 |
| JP | 2002-348737 | 12/2002 |
| JP | 2005-013492 | 1/2005 |
| JP | 2006-149739 | 6/2006 |
| JP | 2007-054778 | 3/2007 |
| WO | WO 02/46504 | 6/2002 |
| WO | WO 2004/091726 | 10/2004 |

(56) References Cited

FOREIGN PATENT DOCUMENTS

| | | |
|---|---|---|
| WO | WO 2005/111291 A1 | 2/2005 |
| WO | WO 2007/112877 | 10/2007 |

OTHER PUBLICATIONS

Supplemental Search Report for European Application No. 07872253 dated Oct. 28, 2011.

Lieberman and Stewart, Propylene Polymers, Encyclopedia of Polymer Science and Technology, p. 297-358, online posting Oct. 15, 2004.

Dahiya et al., Melt Blown Technolgoy, http://web.utk.edu/~mse/Textiles/Melt%20Blown%20Technology.htm, obtained Dec. 29, 2016.

* cited by examiner

FLAT-FOLD RESPIRATOR WITH MONOCOMPONENT FILTRATION/STIFFENING MONOLAYER

CROSS REFERENCE TO RELATED APPLICATIONS

This application is a continuation-in-part of U.S. patent application Ser. No. 11/457,899 now abandoned and Ser. No. 11/457,906 now abandoned (both filed Jul. 17, 2006) and of U.S. patent application Ser. No. 11/461,128, now U.S. Pat. No. 7,905,973, Ser. No. 11/461,136, now U.S. Pat. No. 7,902,096, Ser. No. 11/461,145, now U.S. Pat. No. 7,858,163, Ser. No. 11/461,192 now U.S. Pat. 7,807,591 and Ser. No. 11/461,201 now U.S. Pat. No. 9,139,940, (each filed Jul. 31, 2006), the entire disclosures of each of which are incorporated herein by reference.

This invention relates to flat-fold respirators that are worn by persons to protect them from inhaling airborne contaminants.

BACKGROUND

Personal respirators are commonly used to protect a wearer from inhaling particles suspended in the air or from breathing unpleasant or noxious gases. Respirators generally come in one of two types—a molded cup-shaped form or a flat-folded form. The flat-folded form has advantages in that it can be carried in a wearer's pocket until needed, unfolded for use, and re-folded flat for storage. Commercially-available flat-fold respirators typically use a stiffening member (e.g., a resilient supporting framework or other supporting element, see, for example, U.S. Pat. No. 4,300,549 to Parker) or a stiffening layer (e.g., a high basis weight nonwoven web that contains large diameter, high modulus fibers such as polyester fibers, see, for example, U.S. Pat. No. 6,123,077 to Bostock et al.) to impart greater structural stability to the unfolded respirator. The stiffening member or stiffening layer can help the respirator resist deflection during breathing cycles to discourage or prevent the wearer's lips and nostrils from contacting the respirator inner surface.

SUMMARY OF THE INVENTION

Although stiffening members and stiffening layers are beneficial in that they improve the structural integrity of a respirator, the use of such components can undesirably increase overall respirator weight, bulk and cost. Because stiffening members and stiffening layers do not provide significant filtration capabilities, and limit the extent to which unused manufacturing scrap can be recycled, applicants sought to eliminate these components from a flat-fold respirator. Some patents say that a stiffening member or stiffening layer is merely optional or preferred (see e.g., the above-mentioned U.S. Pat. Nos. 6,123,077 and 4,920,960 to Hubbard et al.). It is difficult in practice to eliminate these components because their removal makes the respirator undesirably flimsy when unfolded and worn.

Applicants have now found a way to provide both stiffening and filtration capabilities in a single layer so that a flat-fold respirator can be fashioned which has one or more of reduced weight, bulk and manufacturing cost.

The invention provides in one aspect a flat-fold personal respirator that comprises at least one stiff filtration panel joined to the remainder of the respirator through at least one line of demarcation, the panel comprising a porous monocomponent monolayer nonwoven web that contains charged intermingled continuous monocomponent polymeric fibers of the same polymeric composition and that has sufficient basis weight or inter-fiber bonding so that the web exhibits a Gurley Stiffness greater than 200 mg and the respirator exhibits less than 20 mm $H_2O$ pressure drop. The respirator is capable of being folded to a substantially flat-folded configuration and unfolded to a convex open configuration.

In another aspect the invention provides a process for making a flat-fold personal respirator, which process comprises:

a) obtaining a monocomponent monolayer nonwoven web that contains electrically charged, intermingled continuous monocomponent polymeric fibers of the same polymeric composition, the web having sufficient basis weight or inter-fiber bonding so as to exhibit a Gurley Stiffness greater than 200 mg;
b) forming at least one line of demarcation in the charged web to provide at least one panel that is defined at least in part by the line of demarcation; and
c) adapting the web to provide a mask body that exhibits less than 20 mm $H_2O$ pressure drop and is capable of being folded to a substantially flat-folded configuration and unfolded to a convex open configuration.

In yet another aspect the invention provides a process for making a flat-fold personal respirator, which process comprises:

a) forming a monocomponent monolayer nonwoven web of intermingled continuous monocomponent polymeric fibers of the same polymeric composition and charging the web, the web having sufficient basis weight or inter-fiber bonding so as to exhibit a Gurley Stiffness greater than 200 mg;
b) forming at least one line of demarcation in the charged web to provide at least one panel that is defined at least in part by the line of demarcation; and
c) adapting the web to provide a mask body that exhibits less than 20 mm $H_2O$ pressure drop and is capable of being folded to a substantially flat-folded configuration and unfolded to a convex open configuration.

Product complexity and waste may be reduced by eliminating a separate stiffening layer and by potentially eliminating other layers such as an outer cover web layer. Also, if the stiffening layer fibers and the fibers of any other layer (such as an inner or outer cover web layer) in the respirator all have the same polymeric composition and extraneous bonding materials are not employed, unused scrap may be recovered and fully recycled to make additional starting material.

These and other aspects of the invention will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWING

Like reference symbols in the various figures of the drawing indicate like elements. The elements in the drawing are not to scale.

DETAILED DESCRIPTION

Figure 1:
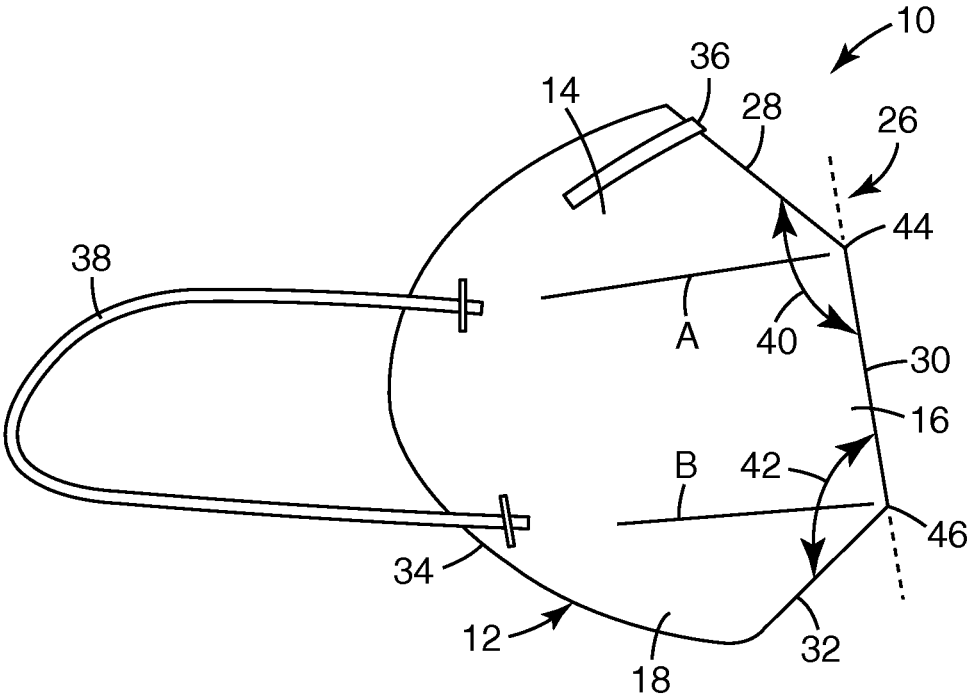
FIG. 1 is a side view of a flat fold respirator 10 in accordance with the present invention.

As used in this document, the terms provided below will have the meaning as given:

"Attenuating the filaments into fibers" means the conversion of a segment of a filament into a segment of greater length and smaller size.

"Bimodal mass fraction/fiber size mixture" means a collection of fibers having a histogram of mass fraction vs. fiber size in μm exhibiting at least two modes. A bimodal mass fraction/fiber size mixture may include more than two modes, for example it may be a trimodal or higher-modal mass fraction/fiber size mixture.

"Bimodal fiber count/fiber size mixture" means a collection of fibers having a histogram of fiber count (frequency) vs. fiber size in μm exhibiting at least two modes whose corresponding fiber sizes differ by at least 50% of the smaller fiber size. A bimodal fiber count/fiber size mixture may include more than two modes, for example it may be a trimodal or higher-modal fiber count/fiber size mixture.

"Bonding" when used with respect to a fiber or collection of fibers means adhering together firmly; bonded fibers generally do not separate when a web is subjected to normal handling.

"Charged" when used with respect to a collection of fibers means fibers that exhibit at least a 50% loss in Quality Factor QF (discussed below) after being exposed to a 20 Gray absorbed dose of 1 mm beryllium-filtered 80 KVp X-rays when evaluated for percent dioctyl phthalate (% DOP) penetration at a face velocity of 7 cm/sec.

"Continuous" when used with respect to a fiber or collection of fibers means fibers having an essentially infinite aspect ratio (viz., a ratio of length to size of e.g., at least about 10,000 or more).

"Effective Fiber Diameter" (EFD) when used with respect to a collection of fibers means the value determined according to the method set forth in Davies, C. N., "The Separation of Airborne Dust and Particles", Institution of Mechanical Engineers, London, Proceedings 1B, 1952 for a web of fibers of any cross-sectional shape be it circular or non-circular.

"Filtration panel" means a portion of a fold-flat respirator having filtration capabilities sufficient to remove one or more airborne small particle contaminants and having one or more discernible boundaries when the respirator is unfolded for use.

"Flat-fold respirator" means a device that can be folded flat for storage, can be unfolded to a shape that fits over at least the nose and mouth of a person and removes one or more airborne contaminants when worn by such person.

"Line of demarcation" means a fold, seam, weld, bond or other visible feature that provides a discernible boundary and optionally a hinge region for a respirator filtration panel.

"Meltblown" when used with respect to a nonwoven web means a web formed by extruding a fiber-forming material through a plurality of orifices to form filaments while contacting the filaments with air or other attenuating fluid to attenuate the filaments into fibers and thereafter collecting a layer of the attenuated fibers.

"Meltblown fibers" means fibers prepared by extruding molten fiber-forming material through orifices in a die into a high-velocity gaseous stream, where the extruded material is first attenuated and then solidifies as a mass of fibers. Meltblown fibers generally are not oriented. Although meltblown fibers have sometimes been reported to be discontinuous, the fibers generally are long and entangled sufficiently that it is usually not possible to remove one complete meltblown fiber from a mass of such fibers or to trace one meltblown fiber from beginning to end.

"Meltspun" when used with respect to a nonwoven web means a web formed by extruding a low viscosity melt through a plurality of orifices to form filaments, quenching the filaments with air or other fluid to solidify at least the surfaces of the filaments, contacting the at least partially solidified filaments with air or other fluid to attenuate the filaments into fibers and collecting a layer of the attenuated fibers.

"Meltspun fibers" means fibers issuing from a die and traveling through a processing station in which the fibers are permanently drawn and polymer molecules within the fibers are permanently oriented into alignment with the longitudinal axis of the fibers. Such fibers are essentially continuous and are entangled sufficiently that it is usually not possible to remove one complete meltspun fiber from a mass of such fibers.

"Microfibers" means fibers having a median size (as determined using microscopy) of 10 μm or less; "ultrafine microfibers" means microfibers having a median size of two μm or less; and "submicron microfibers" means microfibers having a median size one μm or less. When reference is made herein to a batch, group, array, etc. of a particular kind of microfiber, e.g., "an array of submicron microfibers," it means the complete population of microfibers in that array, or the complete population of a single batch of microfibers, and not only that portion of the array or batch that is of submicron dimensions.

"Mode" when used with respect to a histogram of mass fraction vs. fiber size in μm or a histogram of fiber count (frequency) vs. fiber size in μm means a local peak whose height is larger than that for fiber sizes 1 and 2 μm smaller and 1 and 2 μm larger than the local peak.

"Monocomponent" when used with respect to a fiber or collection of fibers means fibers having essentially the same composition across their cross-section; monocomponent includes blends (viz., polymer alloys) or additive-containing materials, in which a continuous phase of uniform composition extends across the cross-section and over the length of the fiber.

"Monolayer" when used with respect to a nonwoven web means having (other than with respect to fiber size) a generally uniform distribution of similar fibers throughout a cross-section of the web, and having (with respect to fiber size) fibers representing each modal population present throughout a cross-section of the web. Such a monolayer web may have a generally uniform distribution of fiber sizes throughout a cross-section of the web or may, for example, have a depth gradient of fiber sizes such as a preponderance of larger size fibers proximate one major face of the web and a preponderance of smaller size fibers proximate the other major face of the web.

"Nominal Melting Point" means the peak maximum of a second-heat, total-heat-flow differential scanning calorimetry (DSC) plot in the melting region of a polymer if there is only one maximum in that region; and, if there is more than one maximum indicating more than one melting point (e.g., because of the presence of two distinct crystalline phases), as the temperature at which the highest-amplitude melting peak occurs.

"Nonwoven web" means a fibrous web characterized by entanglement or point bonding of the fibers.

"Of the same polymeric composition" means polymers that have essentially the same repeating molecular unit, but which may differ in molecular weight, melt index, method of manufacture, commercial form, etc., and which may optionally contain minor amounts (e.g., less than about 3 wt. %) of an electret charging additive.

"Oriented" when used with respect to a polymeric fiber or collection of such fibers means that at least portions of the polymeric molecules of the fibers are aligned lengthwise of the fibers as a result of passage of the fibers through equipment such as an attenuation chamber or mechanical drawing machine. The presence of orientation in fibers can be detected by various means including birefringence measurements and wide-angle x-ray diffraction.

"Porous" means air-permeable.

"Separately prepared smaller size fibers" means a stream of smaller size fibers produced from a fiber-forming apparatus (e.g., a die) positioned such that the stream is initially spatially separate (e.g., over a distance of about 1 inch (25 mm) or more from, but will merge in flight and disperse into, a stream of larger size fibers.

"Self-supporting" when used with respect to a nonwoven web or panel means that the web or panel does not include a contiguous reinforcing layer of wire, mesh, or other stiffening material having a composition different from that of the web panel and providing increased stiffness to one or more portions of the web or panel.

"Size" when used with respect to a fiber means the fiber diameter for a fiber having a circular cross section, or the length of the longest cross-sectional chord that may be constructed across a fiber having a non-circular cross-section.

Figure 2:
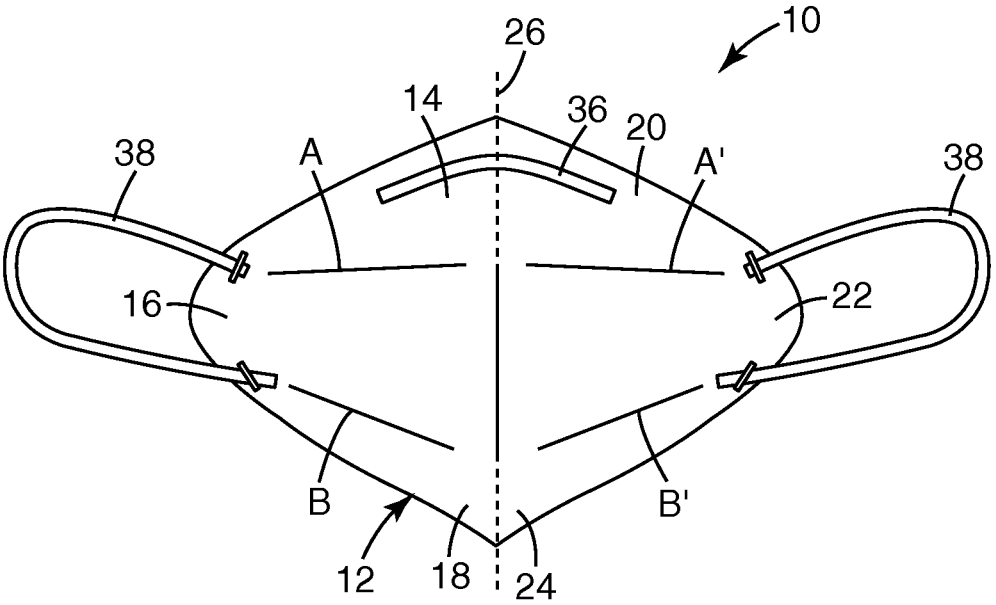
FIG. 2 is a front view of the flat fold respirator 10 of FIG. 1 shown in an open, ready-to-use configuration.

In the practice of the present invention, a variety of flat-fold personal respirators may be made using the stiff filtration panels described herein. One such flat-fold respirator is shown in FIG. 1, which illustrates a respirator 10 having first and second lines of demarcation A and B. FIG. 2 shows a front view of device 10 in an open ready-to-use configuration. Device 10 includes a main body 12 containing six filtration panels. Three of those panels are shown in FIG. 1 as right upper panel 14, right central panel 16 and right lower panel 18 (using the terms left, right, upper and lower in the wearer's sense). The remaining three panels are shown in FIG. 2 as left upper panel 20, left central panel 22 and left lower panel 24. Vertical bisecting line 26 divides the left and right halves of device 10. Panels 14 and 20 are connected through welded seam 28. Panels 16 and 22 are connected through central vertical fold 30. Panels 18 and 24 are connected through welded seam 32. Panels 14 and 16 are connected through welded bondline A, which in this embodiment extends over part of but not the entire region between panels 14 and 16. In similar fashion, panels 16 and 18 are connected through welded bondline B, panels 20 and 22 are connected through welded bondline A' and panels 22 and 24 are connected through welded bondline B'. One or more of panels 14, 16, 18, 20, 22 and 24 may be provided as separate components, and at least one, more preferably at least two and most preferably all of the filtration panels 14, 16, 18, 20, 22 and 24 is a stiff filtration panel as described in more detail below. When each of the filtration panels 14, 16, 18, 20, 22 and 24 is a stiff filtration panel, they preferably are formed in a single preform made from the disclosed monocomponent monolayer nonwoven web. The disclosed stiff filtration panel provides both airborne contaminant filtration and respirator stiffening properties in a single nonwoven layer exclusive of any inner or outer cover web layers which may also be present. Device 10 may be folded in half (e.g., for storage in a package prior to use or in a wearer's pocket) along line 26 which in this embodiment corresponds to fold 30. Facial edge 34 is shaped to provide a suitable seal against the cheeks, chin and nose of a wearer. Device 10 preferably also includes additional components such as a reinforcing nosepiece 36 and attachments such as earloops 38. Some wearers will prefer a device attached via one or two headbands (not shown in FIG. 1 and FIG. 2) in place of earloops 38. The shape and the size of device 10 may conveniently be varied by altering the shape or orientation of seams 28 and 32. Seams 28 and 32 may for example be straight to curvilinear as desired to achieve good conformance to the wearer's face. The orientation of seams 28 and 32 may conveniently be defined by referring to first angle 40 and second angle 42, which respectively are drawn with reference to fold 30 and first point of origin 44 or fold 30 and second point of origin 46. First angle 40 may for example be about 110 degrees to about 175 degrees or about 140 degrees to about 155 degrees. Second angle 42 may for example be about 100 degrees to about 165 degrees or about 135 degrees to about 150 degrees. By varying the shape of seams 28 and 32, first angle 40, or second angle 42, the conformance of device 10 to a wearer's face can be easily altered to accommodate various face sizes and shapes. Persons having ordinary skill in the art will appreciate that by varying the angles of each of first angle 40 and second angle 42, the length of seams 28 and 32 and the size of device 1 welded, stitched or otherwise fastened 0 may change accordingly. Seams 28 and 32 may for example have a length of about 40 mm to about 80 mm, and need not necessarily have the same lengths. Aside from the stiff filtration panels, further details regarding respirators such as device 10 and their manufacture may be found in U.S. Pat. No. 6,394,090 B1 (Chen et al.), the entire disclosure of which is incorporated by reference.

Figure 3:
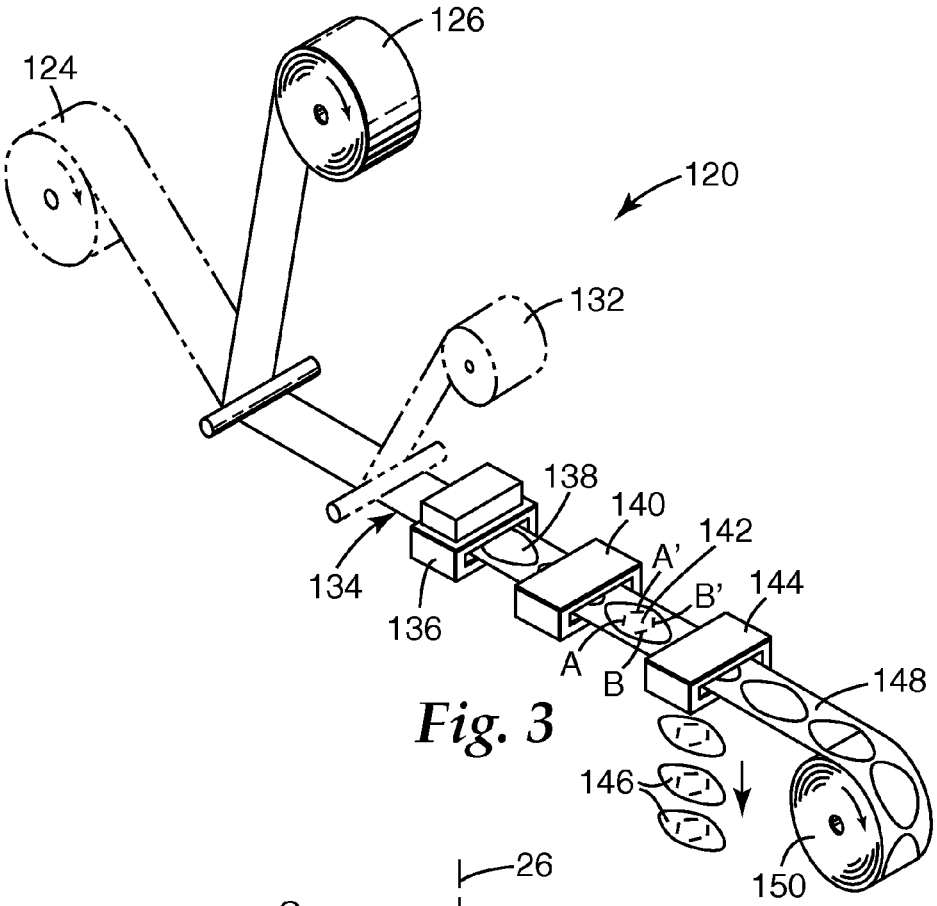
FIG. 3 is a schematic illustration of an exemplary manufacturing process for making flat-fold respirators in accordance with the present invention.

FIG. 3 shows a schematic illustration of one production process 120 for manufacturing a flat-folded respiratory device like that shown in FIG. 1 and FIG. 2. An optional inner cover web 124 and a stiff filtration layer 126 are preferably supplied in roll form for a substantially continuous process. To facilitate recycling of unused scrap, inner cover web 124 desirably is a monocomponent web of the same polymeric composition as stiff filtration layer 126. For example, inner cover web 124 and stiff filtration layer 126 may both be polypropylene webs. Stiff filtration layer 126 may optionally be covered by an outer cover web 132. If used, outer cover web 132 desirably is a monocomponent web of the same polymeric composition as inner cover web 124 and stiff filtration layer 126. Desirably at least the eventual outer surface (viz., the surface which will face away from the wearer in the completed respirator) of stiff filtration layer 126 is calendered, as that may discourage shedding sufficiently so that outer cover web 132 may be omitted. If both major surfaces of stiff filtration layer 126 are sufficiently calendared, shedding may be discouraged sufficiently so that both inner cover web 124 and outer cover web 132 may be omitted.

The resulting one-, two- or three-layer web assembly 134 may be held together by surface forces, electrostatic forces, thermal bonding, adhesive or other suitable measures that will be familiar to persons having ordinary skill in the art. Web assembly 134 can next be welded and trimmed at welding station 136 to form a partial preform 138. Preform 138 desirably is substantially flat so that the desired respirator may be formed at relatively high rates of speed and relatively low cost without requiring specialized manufacturing equipment such as mating shell molds. Partial preform 138 next passes through demarcation station 140 where at least one line of demarcation is formed in partial preform 138 to create demarked preform 142. The desired line or lines of demarcation may be formed by a variety of techniques including ultrasonic welding, application of pressure (with or without the presence of heat), stitching, application of adhesive bars, and the like. The demarked preform 142 shown in FIG. 3 includes four lines of demarcation identified as A, A', B, and B'. The line or lines of demarcation may help prevent or discourage delamination of layers in the preform, may increase stiffness of one or more of the filtration panels during wear, and may improve flexibility at the boundaries between filtration panels when the respirator is unfolded for use or folded for storage. The demarked preforms 142 can next be advanced to cutting station 144 where completed preforms 146 are removed from web assembly 134 leaving perforated scrap portion 148 which may be wound up on take-up reel 150. If the various layers in scrap portion 148 are webs having the same polymeric composition, then scrap portion 148 may immediately or at any convenient later stage be recovered and recycled (using for example pulverization devices, extruders or other recycling equipment that will be familiar to persons having ordinary skill in the art) so that it may be made into new starting material. The starting material may for example be used to make one or both of cover web 124 and stiff filtration layer 126, with appropriate adjustment being made for the amount of electret charging additive if employed to make the filtration layer 126.

Figure 4:
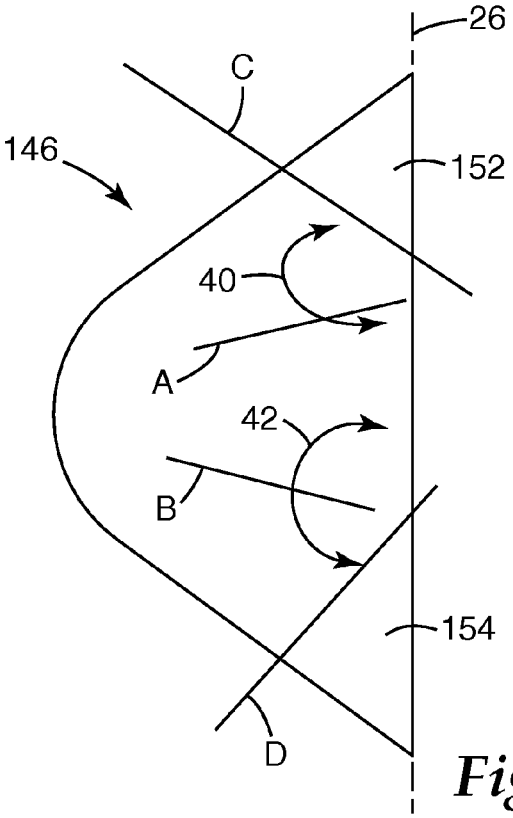
FIG. 4 is a schematic illustration of a preform 146 made using the process of FIG. 3 in accordance with the present invention.

Referring now to FIG. 4, the preform 146 may next be folded along bisecting fold 18, then welded, stitched or otherwise fastened along lines C and D at predetermined angles 40 and 42 to form seams 28 and 32 (shown in FIG. 1 and FIG. 2) which will affect the eventual size of device 10. Preform 142 may also (e.g., before, during or after seams 28 and 32 are formed) be trimmed to remove waste portions 152 and 154. If the various layers in waste portions 152 and 154 each have the same polymeric composition, then waste portions 152 and 154 may be recycled and made into new starting material as described above. Any other desired attachments may be affixed, and the completed respirator may be packaged in any convenient fashion including individual packaging and bulk packaging. Persons having ordinary skill in the art will appreciate that attachments such as nosepiece 36 may more conveniently be affixed at other stages of the manufacturing process. For example, a nosepiece may be positioned on an outer or an inner surface of either the inner cover web 124 or stiff filtration layer 126 before the webs are brought together, or on an inner or outer surface of preform 138 before the preform is cut from waste portion 148, or on or inside preform 142 before or after seams 28 and 32 are formed.

Figure 5:
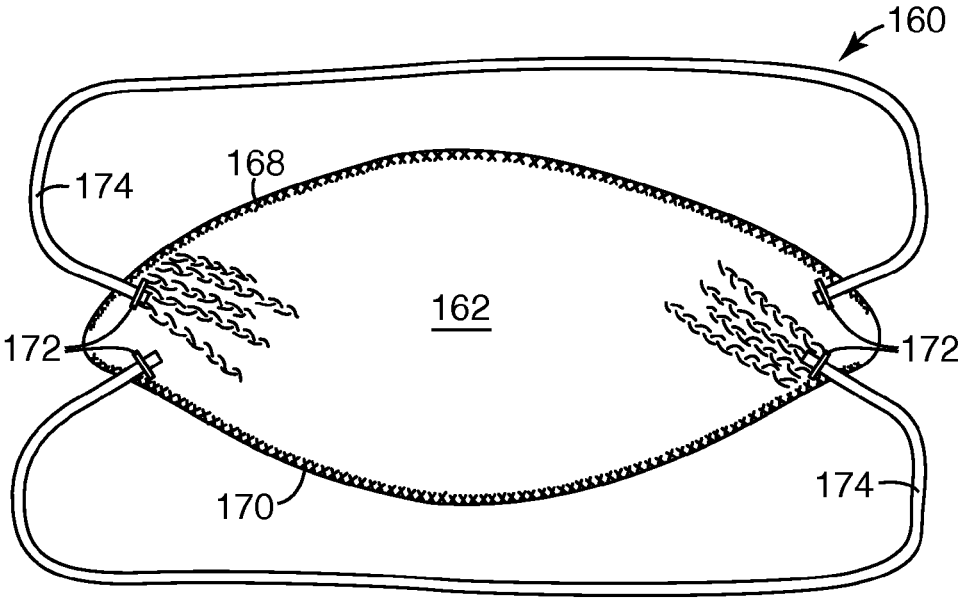
FIG. 5 is a front view of another embodiment of a flat fold respirator 160 in accordance with the present invention in its flat-fold configuration.
Figure 6:
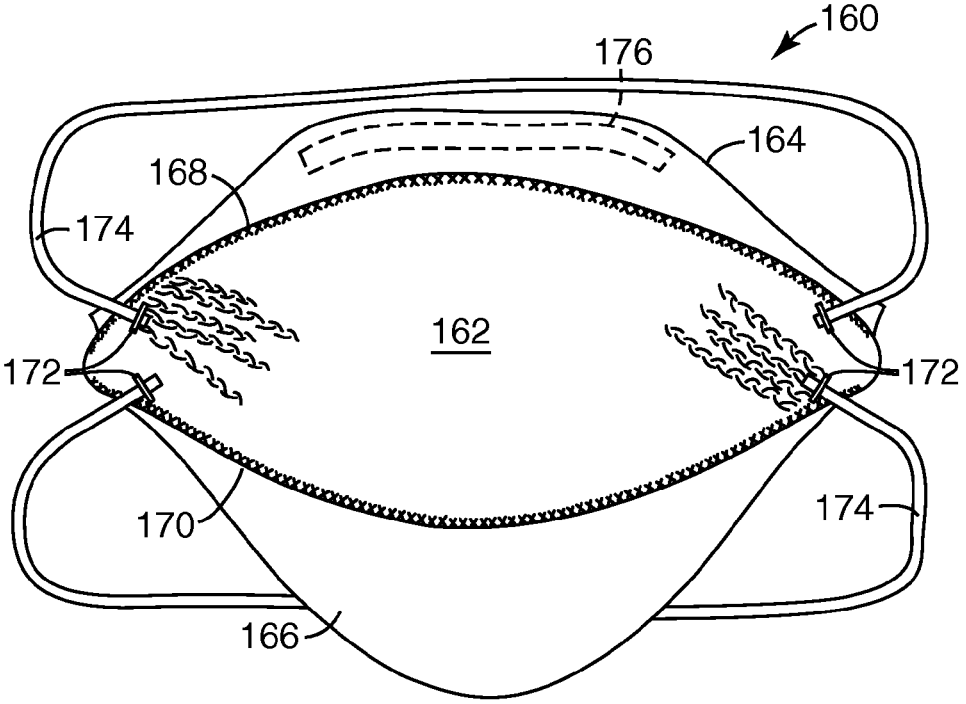
FIG. 6 is a front view of the flat fold respirator 160 of FIG. 5 in its open, ready-to-use configuration in accordance with the present invention.

Another flat-fold respirator which may be formed from the disclosed stiff filtration panel is shown in FIG. 5 and FIG. 6, which respectively show a device 160 in its flat-folded and unfolded, open ready-to-use configurations. Device 160 includes a central panel 162 which desirably is made from the disclosed stiff filtration web. Device 160 also includes upper panel 164 and lower panel 166 which may also be made from the disclosed stiff filtration web but desirably are made from a conventional rather than stiff filtration web. Panel 162 is respectively joined to panels 164 and 166 through seams 168 and 170. Panel 162 desirably has a substantially elliptical shape and seams 168 and 170 desirably are curved or curvilinear in order to provide a respirator having comfortable fit characteristics including an off-the-face configuration. In the embodiment shown in FIG. 5 and FIG. 6, the central panel 162, upper panel 164 and lower panel 166 each are non-pleated. Device 160 may also include attachment points 172, headband 174 and nose clip 176. Further details regarding respirators like device 160 may be found in U.S. Pat. No. 6,123,077 (Bostock et al.), the entire disclosure of which is incorporated by reference. Another exemplary embodiment of such a device includes a central panel made from the disclosed stiff filtration web and having a width of about 160 to 220 mm and a height of about 30 to 110 mm, the device being capable of being folded flat for storage with the upper panel or lower panel in at least partial face-to-face contact with a surface of the central panel and in contact with a portion of the lower panel or upper panel.

A variety of other flat-fold respirators may be formed from the disclosed stiff filtration web. Exemplary such respirators include those shown in U.S. Pat. Nos. 2,007,867 (Le Duc), 2,265,529 (Kemp), 2,565,124 (Durborow), 2,634,724 (Burns), 2,752,916 (Haliczer), 3,664,335 (Boucher et al.), 3,736,928 (Andersson et al.), 3,971,369 (Aspelin et al.), 4,248,220 (White), 4,300,549 (Parker), 4,417,575 (Hilton et al.), 4,419,993 (Peterson), 4,419,994 (Hilton), 4,600,002 (Maryyanek et al.), 4,920,960 (Hubbard et al.), 5,322,061 (Brunson), 5,701,892 (Bledstein), 5,717,991 (Nozaki et al.), 5,724,964 (Brunson et al.), 5,735,270 (Bayer) and 6,474,336 B1 (Wolfe), and UK Patent Application No. GB 2 103 491 (American Optical Corporation).

The disclosed respirators may be pleated or non-pleated and desirably are non-pleated. The disclosed respirators may also include one or more molded portions or panels but desirably are made without requiring molding. The disclosed stiff filtration panel may represent a minority, majority or even all of the available respirator filtration area. The disclosed folds, seams, welds, bonds or other lines of demarcation may be straight, curved or curvilinear. In some embodiments containing multiple lines of demarcation, a line or lines of demarcation may intersect with another line or lines of demarcation. In other embodiments no line of demarcation will intersect with another line of demarcation. The disclosed respirators may have less than 20 mm $H_2O$ pressure drop when exposed to a 1 wt. % sodium chloride aerosol flowing at 95 liters/min. For example, they may have less than 10 mm $H_2O$ pressure drop. The disclosed respirators may also have less than 20% maximum penetration when exposed to a 1 wt. % sodium chloride aerosol flowing at 95 liters/min. For example, they may have less than 5% maximum loading penetration or less than 1% maximum loading penetration when exposed to a 0.075 μm 2% sodium chloride aerosol flowing at 85 liters/min.

A variety of polymeric fiber-forming materials may be used to prepare the disclosed stiff filtration webs. The polymer may be essentially any semicrystalline thermoplastic fiber-forming material that can be subjected to the chosen fiber and web formation process and that is capable of providing a charged nonwoven web that will maintain satisfactory electret properties or charge separation. Preferred polymeric fiber-forming materials are non-conductive semicrystalline resins having a volume resistivity of $10^{14}$ ohm-centimeters or greater at room temperature (22° C.). Preferably, the volume resistivity is about $10^{16}$ ohm-centimeters or greater. Resistivity of the polymeric fiber-forming material may be measured according to standardized test ASTM D 257-93. The polymeric fiber-forming material also preferably is substantially free from components such as antistatic agents that could significantly increase electrical conductivity or otherwise interfere with the fiber's ability to accept and hold electrostatic charges. Some examples of polymers which may be used in chargeable webs include thermoplastic polymers containing polyolefins such as polyethylene, polypropylene, polybutylene, poly(4-methyl-1-pentene) and cyclic olefin copolymers, and combinations of such polymers. Other polymers which may be used but which may be difficult to charge or which may lose charge rapidly include polycarbonates, block copolymers such as styrene-butadiene-styrene and styrene-isoprene-styrene block copolymers, polyesters such as polyethylene terephthalate, polyamides, polyurethanes, and other polymers that will be familiar to those skilled in the art. The disclosed stiff filtration webs preferably are prepared from poly-4-methyl-1 pentene or polypropylene. Most preferably, the webs are prepared from polypropylene homopolymer because of its ability to retain electric charge, particularly in moist environments.

Additives may be added to the polymer to enhance the filtration web's performance, electret charging capability, mechanical properties, aging properties, coloration, surface properties or other characteristics of interest. Representative additives include fillers, nucleating agents (e.g., MILLAD™ 3988 dibenzylidene sorbitol, commercially available from Milliken Chemical), electret charging enhancement additives (e.g., tristearyl melamine, and various light stabilizers such as CHIMASSORB™ 119 and CHIMASSORB 944 from Ciba Specialty Chemicals), cure initiators, stiffening agents (e.g., poly(4-methyl-1-pentene)), surface active agents and surface treatments (e.g., fluorine atom treatments to improve filtration performance in an oily mist environment as described in U.S. Pat. Nos. 6,398,847 B1, 6,397,458 B1, and 6,409,806 B1 to Jones et al.). The types and amounts of such additives will be familiar to those skilled in the art. For example, electret charging enhancement additives are generally present in an amount less than about 5 wt. % and more typically less than about 2 wt. %.

The disclosed stiff filtration web may have a variety of Effective Fiber Diameter values, for example an EFD of about 5 to about 40 μm, or of about 6 to about 35 μm. The web may also have a variety of basis weights, for example a basis weight of about 100 to about 500 grams/$m^2$ (gsm) or about 150 to about 250 gsm. The disclosed web may have a Gurley Stiffness value of at least about 200 mg, at least about 300 mg, at least about 400 mg, at least about 500 mg, at least about 1000 mg or at least about 2000 mg.

Figure 7:
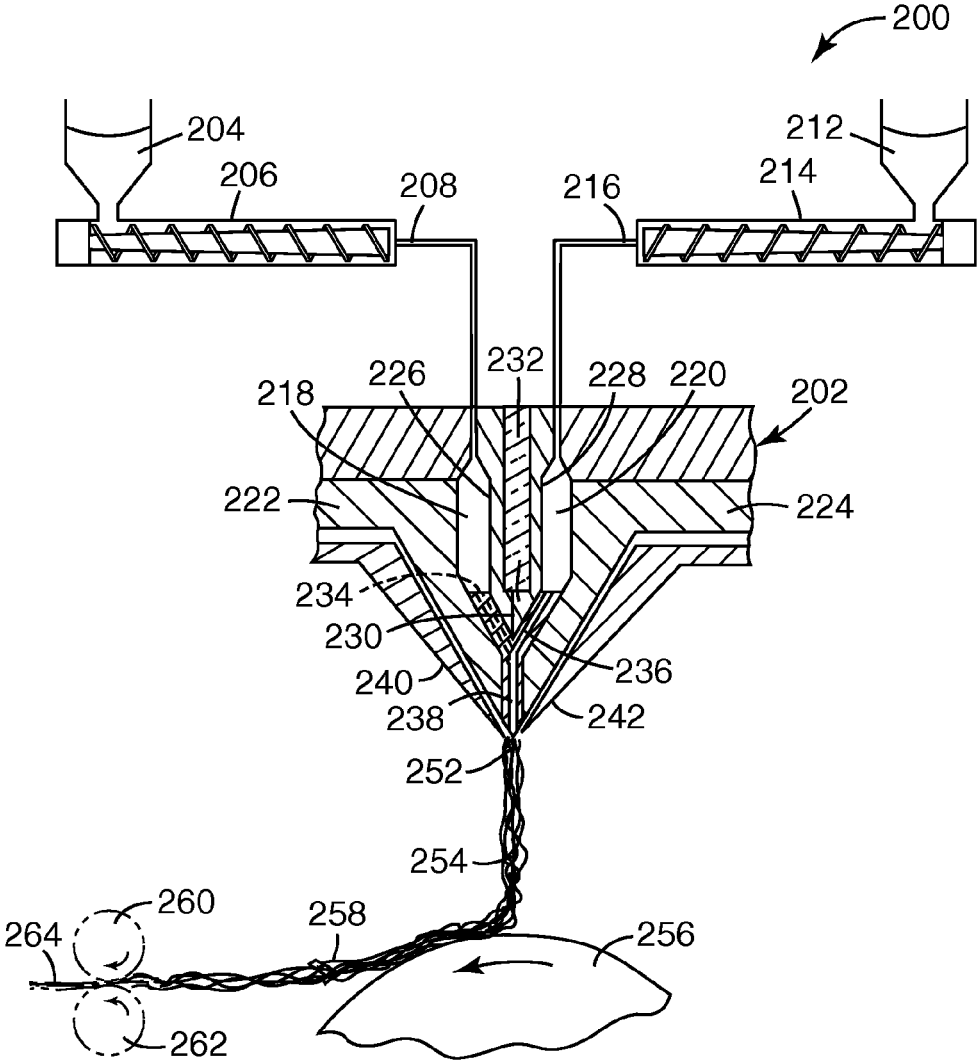
FIG. 7 is a schematic cross-sectional view of an exemplary process for making a stiff monocomponent monolayer web 264, in accordance with the present invention, using a meltblowing die 202 whose orifices 246 and 248 are supplied with polymers of the same polymeric composition flowing at different rates or with different viscosities.
Figure 8:
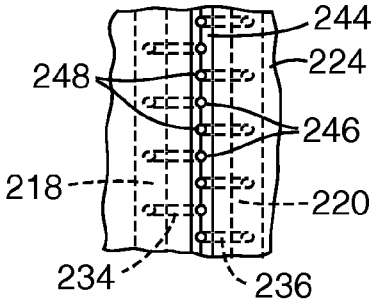
FIG. 8 is an outlet end view of an exemplary meltblowing die for use in the process of FIG. 7.

The disclosed stiff filtration web may conveniently be formed as a web containing a bimodal mass fraction/fiber size mixture of microfibers and larger size fibers, like webs described in the above-mentioned U.S. patent application Ser. Nos. 11/461,136 and 11/461,145 filed Jul. 31, 2006 and in copending U.S. patent application Ser. No. (Attorney Docket No. 62291US002) filed even date herewith and incorporated herein by reference. The manufacturing process described in the latter application is exemplary and may be summarized as follows. FIG. 7 and FIG. 8 illustrate an apparatus 200 for making a porous monocomponent nonwoven web containing a bimodal fiber count/fiber size mixture of intermingled continuous microfibers and larger size fibers of the same polymeric composition. Meltblowing die 202 is supplied with a first liquefied fiber-forming material fed from hopper 204, extruder 206 and conduit 208 at a first flow rate or first viscosity. Die 202 is separately supplied with a second liquefied fiber-forming material of the same polymeric composition fed from hopper 212, extruder 214 and conduit 216 at a second, different flow rate or viscosity. The conduits 208 and 216 are in respective fluid communication with first and second die cavities 218 and 220 located in first and second generally symmetrical parts 222 and 224 which form outer walls for die cavities 218 and 220. First and second generally symmetrical parts 226 and 228 form inner walls for die cavities 218 and 220 and meet at seam 230. Parts 226 and 228 may be separated along most of their length by insulation 232. Deflector plates 240 and 242 direct streams of attenuating fluid (e.g., heated air) so that they converge on an array of filaments 252 issuing from meltblowing die 202 and attenuate the filaments 252 into fibers 254. The fibers 254 land against porous collector 256 and form a self-supporting nonwoven meltblown web 258. Web 258 may optionally be calendered using for example rollers 260 and 262 to provide calendered web 264. The rates at which polymer is supplied from hoppers 204 and 212, the rate at which collector 256 is operated or the temperatures employed when operating apparatus 200 may be adjusted to provide a collected web having the desired degree of Gurley Stiffness.

FIG. 8 shows meltblowing die 202 in outlet end perspective view, with the attenuating gas deflector plates 240 and 242 removed. Parts 222 and 224 meet along seam 244 in which is located a first set of orifices 246 and a second set of orifices 248 and through which the array of filaments 252 will emerge. Die cavities 218 and 220 are in respective fluid communication via passages 234, 236 and 238 with the first set of orifices 246 and second set of orifices 248.

The apparatus shown in FIG. 7 and FIG. 8 may be operated in several modes or modified in several ways to provide a stream of larger size fibers issuing from one die cavity and smaller size fibers issuing from the other die cavity and thereby form a nonwoven web containing a bimodal mass fraction/fiber size mixture of intermingled larger size fibers and smaller size fibers of the same polymeric composition. For example, an identical polymer may be supplied from each extruder 206 and 214 (or, if desired, from a single extruder with two outlets, not shown in FIG. 7) through a larger size conduit 208 into die cavity 218 and through a smaller size conduit 216 into die cavity 220 so as to produce smaller size fibers from orifices 246 and larger size fibers from orifices 248. An identical polymer may be supplied from extruder 206 to die cavity 218 and from extruder 214 to die cavity 220, with extruder 206 having a larger diameter or higher operating temperature than extruder 214 so as to supply the polymer at a higher flow rate or lower viscosity into die cavity 218 and a lower flow rate or higher viscosity into die cavity 220 and produce smaller size fibers from orifices 246 and larger size fibers from orifices 248. Die cavity 218 may be operated at a high temperature and die cavity 220 may be operated at a low temperature so as to produce smaller size fibers from orifices 246 and larger size fibers from orifices 248. Polymers of the same polymeric composition but different melt indices may be supplied from extruder 206 to die cavity 218 and from extruder 214 to die cavity 220 (using for example a low melt index version of the polymer in extruder 206 and a high melt index of the same polymer in extruder 214 so as to produce smaller size fibers from orifices 246 and larger size fibers from orifices 248). Those having ordinary skill in the art will appreciate that other techniques (e.g., the inclusion of a solvent in the stream of liquefied fiber-forming material flowing to die cavity 218, or the use of a shorter flow path through die cavity 218 and a longer flow path through die cavity 220) and combinations of such techniques and the various operating modes discussed above may also be employed.

For the embodiment shown in FIG. 8, the orifices 246 and 248 are arranged in alternating order in a single row across the outlet end of die 202, and in respective fluid communication in a 1:1 ratio with the die cavities 218 and 220. Other arrangements of the orifices and other ratios of the numbers of orifices 246 and 248 may be employed to provide nonwoven webs with altered fiber size distributions. For example, the orifices may be arranged in a plurality of rows (e.g., 2, 3, 4 or more rows) between the attenuating air outlets. Patterns other than rows may be employed if desired, e.g., randomly-located orifices. If arranged in a plurality of rows, each row may contain orifices from only one set or from both the first and second sets. The number of orifices in the first and second set may stand in a variety of ratios, e.g., 10:90, 20:80, 30:70, 40:60, 50:50, 60:40, 70:30, 80:20, 90:10 and other ratios depending on the desired web structure. When orifices from both the first and second set are arranged in a row or rows, the first and second set orifices need not alternate and instead may be arranged in any desired fashion, e.g., 1221, 1122211, 11112221111 and other arrangements depending on the desired web structure. The die tip may contain more than one set of orifices, e.g., first, second, third and if need be further sets of orifices in respective fluid communication with first, second, third and if need be further die cavities within the meltblowing die so as to obtain a web with a tri- or greater-modal distribution of fiber sizes.

The remaining portions of the associated meltblowing apparatus will be familiar to those having ordinary skill in the art. For example, further details regarding meltblowing may be found in Wente, Van A. "Superfine Thermoplastic Fibers," in Industrial Engineering Chemistry, Vol. 48, pages 1342 et seq. (1956), or in Report No. 4364 of the Naval Research Laboratories, published May 25, 1954, entitled "Manufacture of Superfine Organic Fibers" by Wente, V. A.; Boone, C. D.; and Fluharty, E. L.; and in U.S. Pat. No. 5,993,943 (Bodaghi et al.).

Figure 9:
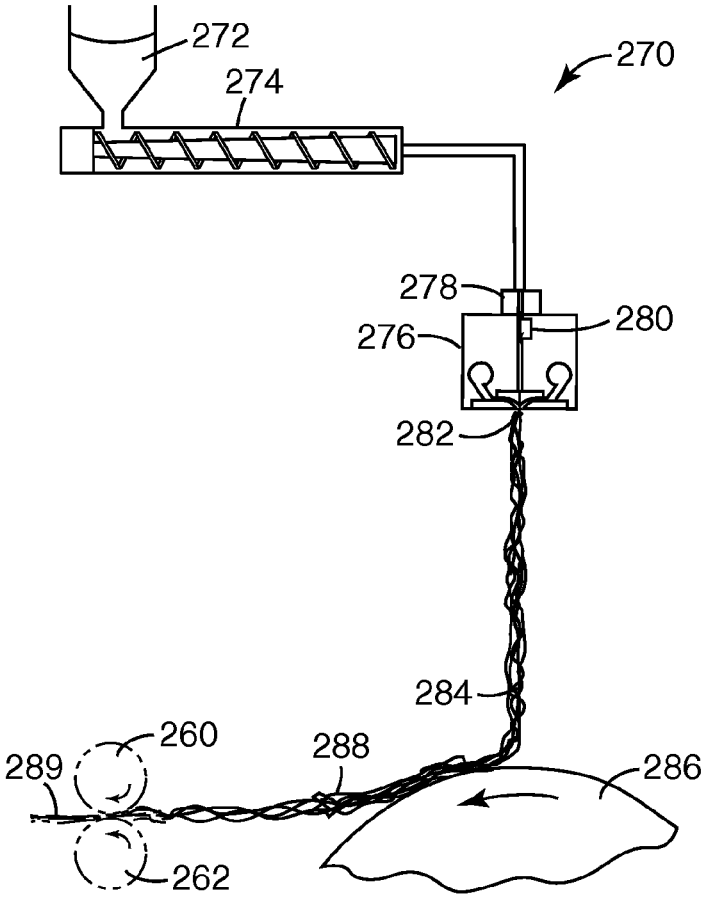
FIG. 9 is a schematic cross-sectional view of an exemplary process for making a stiff monocomponent monolayer web 320, in accordance with the present invention, using a meltblowing die having a plurality of larger and smaller orifices.

The disclosed stiff filtration web may also be formed using meltblowing and an apparatus 270 like that shown in FIG. 9. Liquefied fiber-forming polymeric material fed from hopper 272 and extruder 274 enters meltblowing die 276 via inlet 278, flows through die cavity 280, and exits die cavity 280 through a row (discussed below in connection with FIG. 10) of larger and smaller size orifices arranged in line across the forward end of die cavity 280 and through which the fiber-forming material is extruded as an array of filaments 282. A set of cooperating gas orifices through which a gas, typically heated air, is forced at very high velocity, attenuate the filaments 282 into fibers 284. The fibers 284 land against porous collector 286 and form a self-supporting nonwoven meltblown web 288. The web may optionally be calendered using for example rollers 260 and 262 to provide calendered web 289. The rates at which polymer is supplied from hopper 272, the rate at which collector 286 is operated or the temperatures employed when operating apparatus 270 may be adjusted to provide a collected web having the desired degree of Gurley Stiffness.

Figure 10:
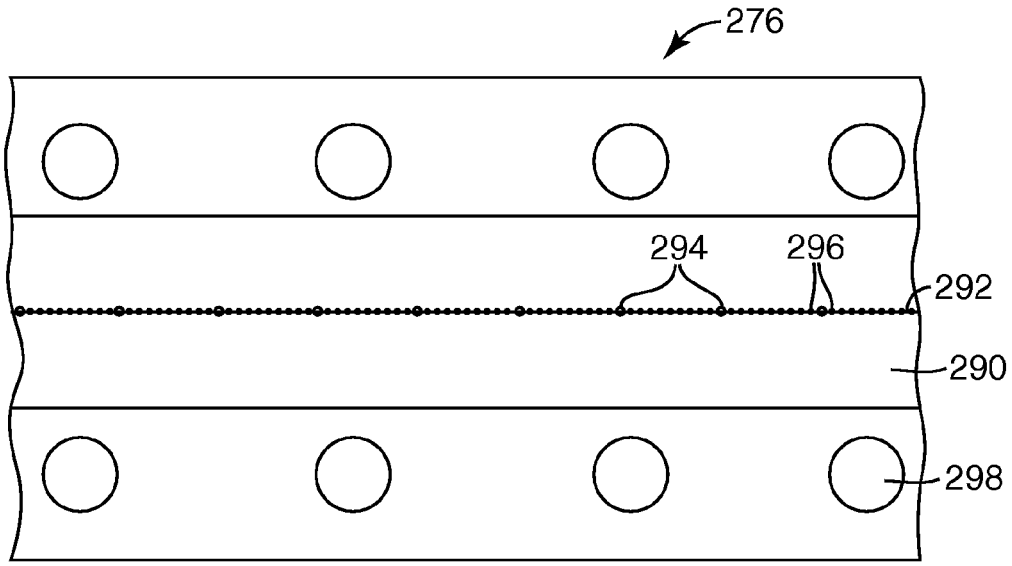
FIG. 10 is an outlet end perspective view of an exemplary meltblowing die for use in the process of FIG. 9.

FIG. 10 shows meltblowing die 276 in outlet end perspective view, with the attenuating gas deflector plates removed. Die 276 includes a projecting tip portion 290 with a row 292 of larger orifices 294 and smaller orifices 296 which define a plurality of flow passages through which liquefied fiber-forming material exits die 276 and forms the filaments 282. Holes 298 receive through-bolts (not shown in FIG. 10) which hold the various parts of the die together. In the embodiment shown in FIG. 10, the larger orifices 294 and smaller orifices 296 have a 2:1 size ratio and there are 9 smaller orifices 296 for each larger orifice 294. Other ratios of larger:smaller orifice sizes may be used, for example ratios of 1.5:1 or more, 2:1 or more, 2.5:1 or more, 3:1 or more, or 3.5:1 or more. Other ratios of the number of smaller orifices per larger orifice may also be used, for example ratios of 5:1 or more, 6:1 or more, 10:1 or more, 12:1 or more, 15:1 or more, 20:1 or more or 30:1 or more. Typically there will be a direct correspondence between the number of smaller orifices per larger orifice and the number of smaller diameter fibers (e.g., microfibers under appropriate operating conditions) per larger size fiber. As will be appreciated by persons having ordinary skill in the art, appropriate polymer flow rates, die operating temperatures and attenuating airflow rates should be chosen so that larger size fibers are produced from attenuated filaments formed by the larger orifices, microfibers are produced from attenuated filaments formed by the smaller orifices, and the completed web has the desired structure, stiffness and other physical properties.

The disclosed bimodal webs may be made in other ways including using meltspinning to form the larger size fibers and using meltblowing to form separately prepared smaller size fibers (e.g., microfibers) of the same polymeric composition. A larger size fiber stream from the meltspinning die and a smaller size fiber stream from the meltblowing die may be positioned so that the two streams merge in flight to provide a combined stream of intermingled larger fibers and smaller fibers which may then land on a suitable collector to provide a nonwoven web containing a bimodal mass fraction/fiber size mixture of the larger and smaller size fibers. Further details regarding this process and the nonwoven webs so made are shown in the above-mentioned U.S. patent application Ser. Nos. 11/457,906, 11/461,145 and 11/461,192.

The disclosed stiff filtration web may also conveniently be formed as a monocomponent monolayer nonwoven web of continuous monocomponent polymeric fibers made by melt-spinning, collecting, heating and quenching the monocomponent polymeric fibers under thermal conditions sufficient to form a web of partially crystalline and partially amorphous oriented meltspun fibers of the same polymeric composition that are bonded to form a coherent and handleable web which further may be softened while retaining orientation and fiber structure, like webs described in the above-mentioned U.S. patent application Ser. Nos. 11/457,899, 11/461,128 and 11/461,201. The manufacturing process described in these applications is exemplary and may be summarized as follows. A collected web of oriented semi-crystalline meltspun fibers which include an amorphous-characterized phase is subjected to a controlled heating and quenching operation that includes a) forcefully passing through the web a fluid heated to a temperature high enough to soften the amorphous-characterized phase of the fibers (which is generally greater than the onset melting temperature of the material of such fibers) for a time too short to melt the whole fibers (viz., causing such fibers to lose their discrete fibrous nature; preferably, the time of heating is too short to cause a significant distortion of the fiber cross-section), and b) immediately quenching the web by forcefully passing through the web a fluid having sufficient heat capacity to solidify the softened fibers (viz., to solidify the amorphous-characterized phase of the fibers softened during heat treatment). Preferably the fluids passed through the web are gaseous streams, and preferably they are air. In this context "forcefully" passing a fluid or gaseous stream through a web means that a force in addition to normal room pressure is applied to the fluid to propel the fluid through the web. In a preferred embodiment, the disclosed quenching step includes passing the web on a conveyor through a device (which can be termed a quenched flow heater, as discussed subsequently) that provides a focused or knife-like heated gaseous (typically air) stream issuing from the heater under pressure and engaging one side of the web, with a gas-withdrawal device on the other side of the web to assist in drawing the heated gas through the web; generally the heated stream extends across the width of the web. The heated stream is in some respects similar to the heated stream from a "through-air bonder" or "hot-air knife," though it may be subjected to special controls that modulate the flow, causing the heated gas to be distributed uniformly and at a controlled rate through the width of the web to thoroughly, uniformly and rapidly heat and soften the melt-spun fibers to a usefully high temperature. Forceful quenching immediately follows the heating to rapidly freeze the fibers in a purified morphological form ("immediately" means as part of the same operation, i.e., without an intervening time of storage as occurs when a web is wound into a roll before the next processing step). In a preferred embodiment, a gas apparatus is positioned downweb from the heated gaseous stream so as to draw a cooling gas or other fluid, e.g., ambient air, through the web promptly after it has been heated and thereby rapidly quench the fibers. The length of heating is controlled, e.g., by the length of the heating region along the path of web travel and by the speed at which the web is moved through the heating region to the cooling region, to cause the intended melting/softening of the amorphous-characterized phase without melting the whole fiber.

Figure 11:
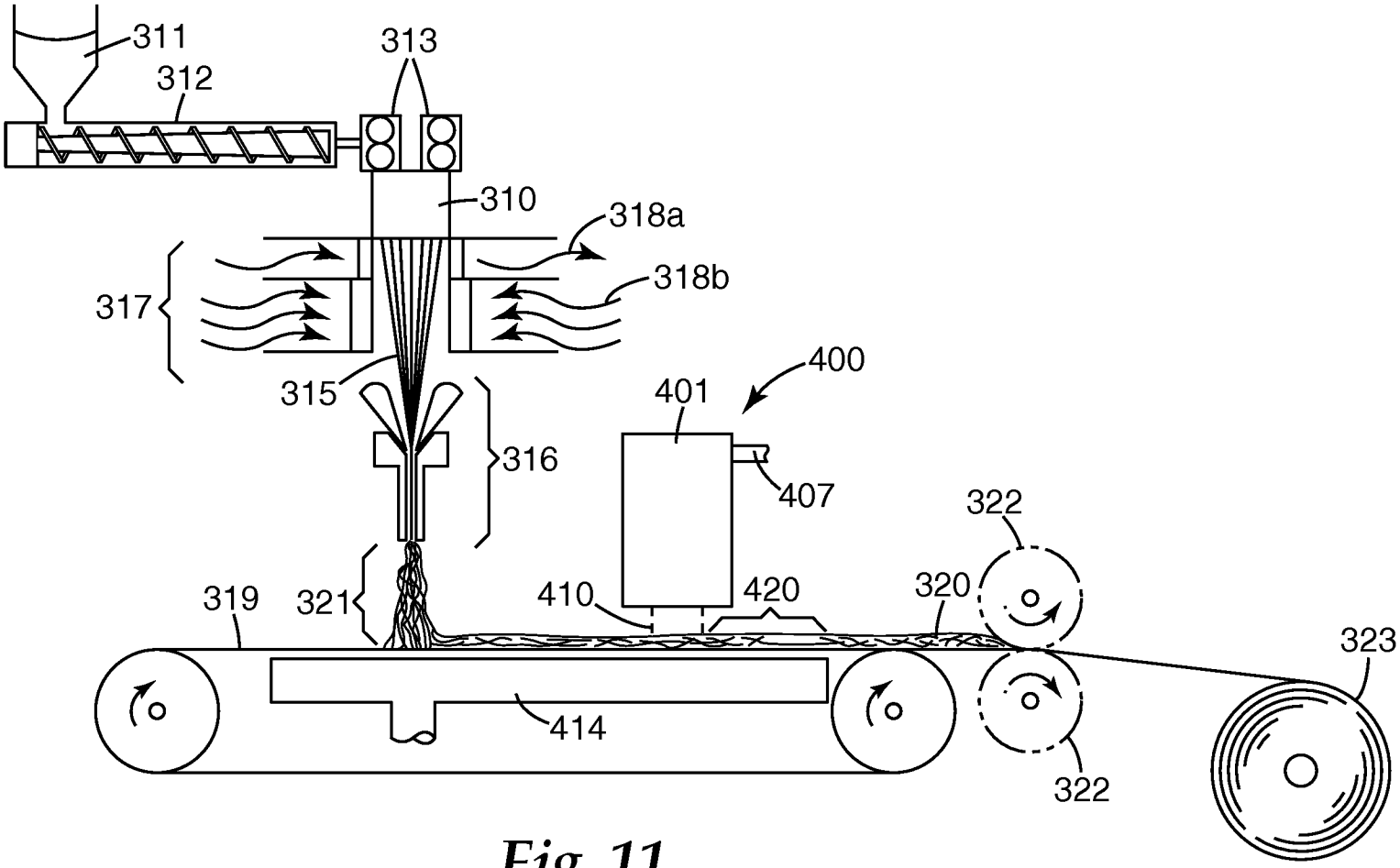
FIG. 11 is a schematic side view of an exemplary process for making a stiff monocomponent monolayer web using meltspinning and a quenched forced-flow heater.

Referring to FIG. 11, fiber-forming material is brought to an extrusion head 310—in this illustrative apparatus, by introducing a polymeric fiber-forming material into a hopper 311, melting the material in an extruder 312, and pumping the molten material into the extrusion head 310 through a pump 313. Solid polymeric material in pellet or other particulate form is most commonly used and melted to a liquid, pumpable state. The extrusion head 310 may be a conventional spinnerette or spin pack, generally including multiple orifices arranged in a regular pattern, e.g., straight-line rows. Filaments 315 of fiber-forming liquid are extruded from the extrusion head and conveyed to a processing chamber or attenuator 316. The attenuator may for example be a movable-wall attenuator like that shown in U.S. Pat. No. 6,607,624 B2 (Berrigan et al.). The distance 317 the extruded filaments 315 travel before reaching the attenuator 316 can vary, as can the conditions to which they are exposed. Quenching streams of air or other gas 318 may be presented to the extruded filaments to reduce the temperature of the extruded filaments 315. Alternatively, the streams of air or other gas may be heated to facilitate drawing of the fibers. There may be one or more streams of air or other fluid—e.g., a first air stream 318*a* blown transversely to the filament stream, which may remove undesired gaseous materials or fumes released during extrusion; and a second quenching air stream 318*b* that achieves a major desired temperature reduction. Even more quenching streams may be used; for example, the stream 318*b* could itself include more than one stream to achieve a desired level of quenching. Depending on the process being used or the form of finished product desired, the quenching air may be sufficient to solidify the extruded filaments 315 before they reach the attenuator 316. In other cases the extruded filaments are still in a softened or molten condition when they enter the attenuator. Alternatively, no quenching streams are used; in such a case ambient air or other fluid between the extrusion head 310 and the attenuator 316 may be a medium for any change in the extruded filaments before they enter the attenuator.

The filaments 315 pass through the attenuator 316 and then exit onto a collector 319 where they are collected as a mass of fibers 320. In the attenuator the filaments are lengthened and reduced in diameter and polymer molecules in the filaments become oriented, and at least portions of the polymer molecules within the fibers become aligned with the longitudinal axis of the fibers. In the case of semicrystalline polymers, the orientation is generally sufficient to develop strain-induced crystallinity, which greatly strengthens the resulting fibers. The collector 319 is generally porous and a gas-withdrawal device 414 can be positioned below the collector to assist deposition of fibers onto the collector. The distance 321 between the attenuator exit and the collector may be varied to obtain different effects. Also, prior to collection, extruded filaments or fibers may be subjected to a number of additional processing steps not illustrated in FIG. 11, e.g., further drawing, spraying, etc. After collection the collected mass 320 is generally heated and quenched as described in more detail below; but the mass could be wound into a storage roll for later heating and quenching if desired. Generally, once the mass 320 has been heated and quenched it may be conveyed to other apparatus such as optional calender rolls 322 and 323, or it may be wound into a storage roll 323 for later use.

Figure 12:
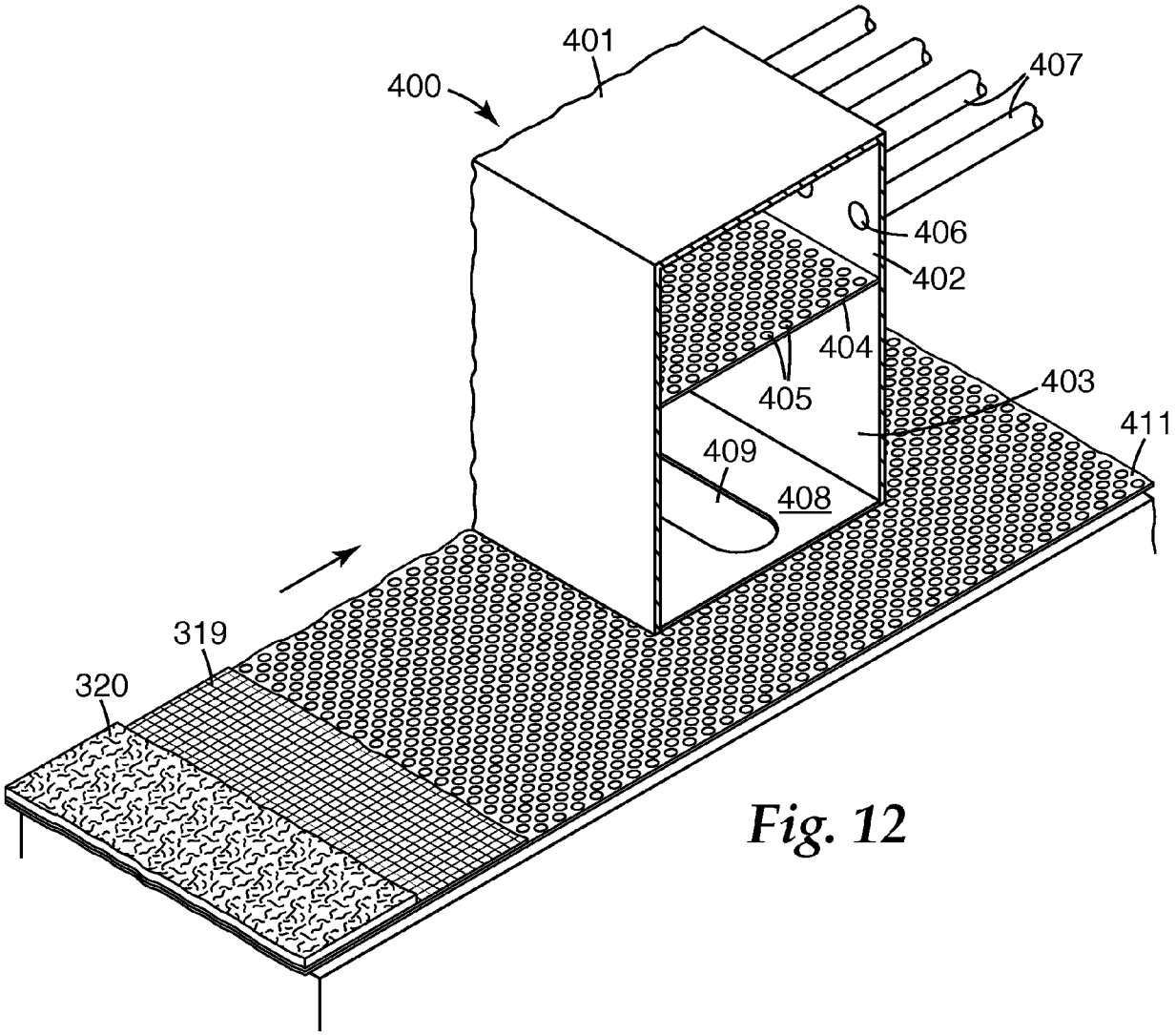
FIG. 12 is a perspective view of a heat-treating part of the apparatus shown in FIG. 11.
Figure 13:
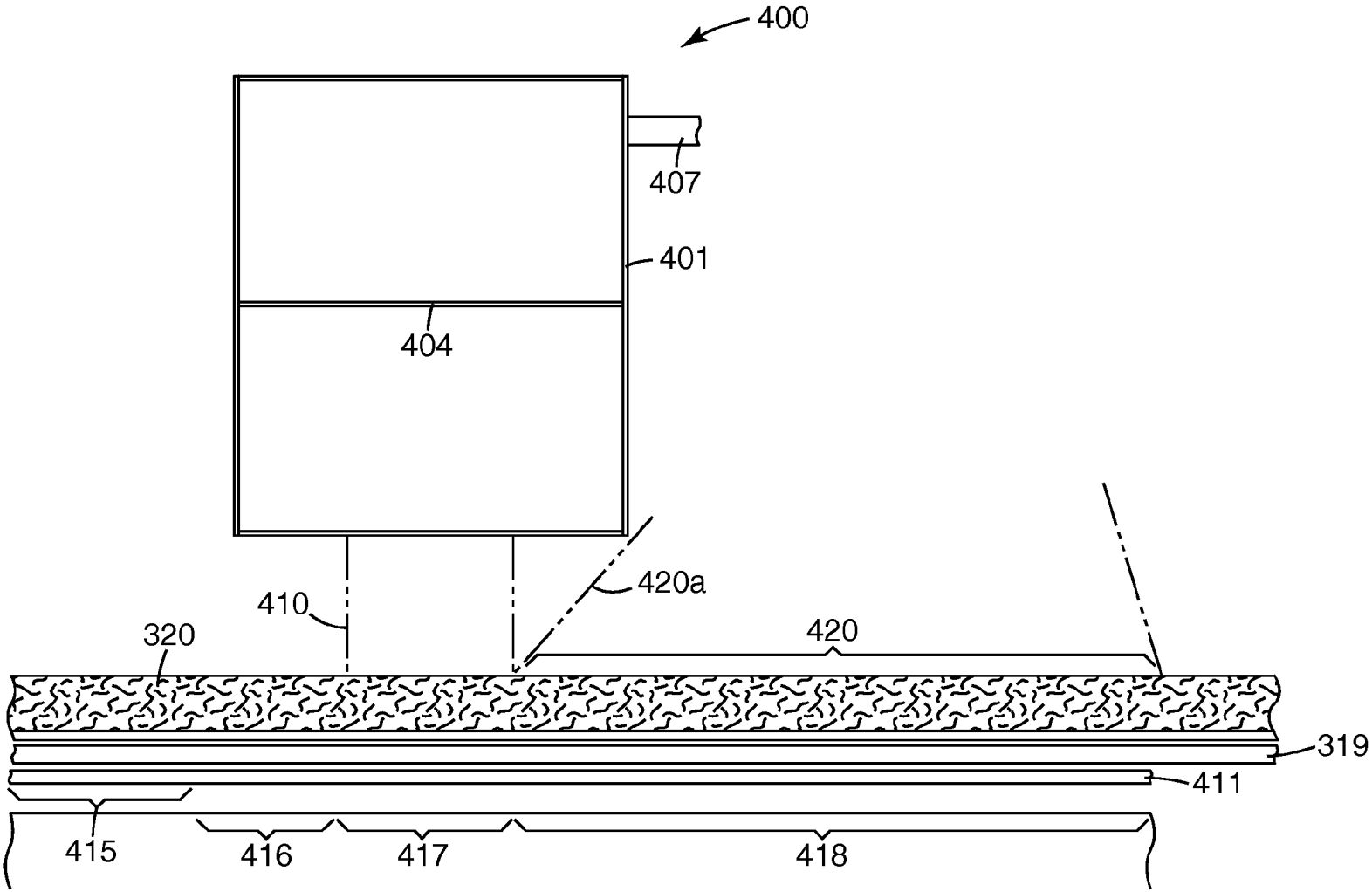
FIG. 13 is a schematic enlarged and expanded view of the apparatus of FIG. 12.

In a preferred method of forming the web, the mass 320 of fibers is carried by the collector 319 through a heating and quenching operation as illustrated in FIG. 12 and FIG. 13. For shorthand purposes we often refer to the apparatus pictured particularly in FIG. 12 and FIG. 13 as a quenched flow heater, or more simply a quenched heater. The collected mass 320 is first passed under a controlled-heating device 400 mounted above the collector 319. The exemplary heating device 400 comprises a housing 401 that is divided into an upper plenum 402 and a lower plenum 403. The upper and lower plenums are separated by a plate 404 perforated with a series of holes 405 that are typically uniform in size and spacing. A gas, typically air, is fed into the upper plenum 402 through openings 406 from conduits 407, and the plate 404 functions as a flow-distribution means to cause air fed into the upper plenum to be rather uniformly distributed when passed through the plate into the lower plenum 403. Other useful flow-distribution means include fins, baffles, manifolds, air dams, screens or sintered plates, i.e., devices that even the distribution of air.

In the illustrative heating device 400 the bottom wall 408 of the lower plenum 403 is formed with an elongated slot 409 through which an elongated or knife-like stream 410 of heated air from the lower plenum is blown onto the mass 320 traveling on the collector 319 below the heating device 400 (the mass 320 and collector 319 are shown partly broken away in FIG. 12). The gas-withdrawal device 414 preferably extends sufficiently to lie under the slot 409 of the heating device 400 (as well as extending downweb a distance 418 beyond the heated stream 410 and through an area marked 420, as will be discussed below). Heated air in the plenum is thus under an internal pressure within the plenum 403, and at the slot 409 it is further under the exhaust vacuum of the gas-withdrawal device 414. To further control the exhaust force a perforated plate 411 may be positioned under the collector 319 to impose a kind of back pressure or flow-restriction means that contributes to spreading of the stream 410 of heated air in a desired uniformity over the width or heated area of the collected mass 320 and be inhibited in streaming through possible lower-density portions of the collected mass. Other useful flow-restriction means include screens or sintered plates.

The number, size and density of openings in the plate 411 may be varied in different areas to achieve desired control. Large amounts of air pass through the fiber-forming apparatus and must be disposed of as the fibers reach the collector in the region 415. Sufficient air passes through the web and collector in the region 416 to hold the web in place under the various streams of processing air. Sufficient openness is needed in the plate under the heat-treating region 417 and quenching region 418 to allow treating air to pass through the web, while sufficient resistance remains to assure that the air is more evenly distributed. The amount and temperature of heated air passed through the mass 320 is chosen to lead to an appropriate modification of the morphology of the fibers. Particularly, the amount and temperature are chosen so that the fibers are heated to a) cause melting/softening of significant molecular portions within a cross-section of the fiber, e.g., the amorphous-characterized phase of the fiber, but b) will not cause complete melting of another significant phase, e.g., the crystallite-characterized phase. We use the term "melting/softening" because amorphous polymeric material typically softens rather than melts, while crystalline material, which may be present to some degree in the amorphous-characterized phase, typically melts. This can also be stated, without reference to phases, simply as heating to cause melting of lower-order crystallites within the fiber. The fibers as a whole remain unmelted, e.g., the fibers generally retain the same fiber shape and dimensions as they had before treatment. Substantial portions of the crystallite-characterized phase are understood to retain their pre-existing crystal structure after the heat treatment. Crystal structure may have been added to the existing crystal structure, or in the case of highly ordered fibers crystal structure may have been removed to create distinguishable amorphous-characterized and crystallite-characterized phases.

To achieve the intended fiber morphology change throughout the collected mass 320, the temperature-time conditions should be controlled over the whole heated area of the mass. Desirable results have been obtained when the temperature of the stream 410 of heated air passing through the web is within a range of 5° C., and preferably within 2 or even 1° C., across the width of the mass being treated (the temperature of the heated air is often measured for convenient control of the operation at the entry point for the heated air into the housing 401, but it also can be measured adjacent the collected web with thermocouples). In addition, the heating apparatus is operated to maintain a steady temperature in the stream over time, e.g., by rapidly cycling the heater on and off to avoid over- or under-heating.

To further control heating and to complete formation of the desired morphology of the fibers of the collected mass 320, the mass is subjected to quenching immediately after the application of the stream 410 of heated air. Such a quenching can generally be obtained by drawing ambient air over and through the mass 320 as the mass leaves the controlled hot air stream 410. Numeral 420 in FIG. 13 represents an area in which ambient air is drawn through the web by the gas-withdrawal device through the web. The gas-withdrawal device 414 extends along the collector for a distance 418 beyond the heating device 400 to assure thorough cooling and quenching of the whole mass 320 in the area 420. Air can be drawn under the base of the housing 401, e.g., in the area 420*a* marked on FIG. 13, so that it reaches the web directly after the web leaves the hot air stream 410. A desired result of the quenching is rapidly to remove heat from the web and the fibers and thereby limit the extent and nature of crystallization or molecular ordering that will subsequently occur in the fibers. Generally the disclosed heating and quenching operation is performed while a web is moved through the operation on a conveyor, and quenching is performed before the web is wound into a storage roll at the end of the operation. The times of treatment depend on the speed at which a web is moved through an operation, but generally the total heating and quenching operation is performed in a minute or less, and preferably in less than 15 seconds. By rapid quenching from the molten/softened state to a solidified state, the amorphous-characterized phase is understood to be frozen into a more purified crystalline form, with reduced molecular material that can interfere with softening, or repeatable softening, of the fibers. Desirably the mass is cooled by a gas at a temperature at least 50° C. less than the Nominal Melting Point; also the quenching gas or other fluid is desirably applied for a time on the order of at least one second. In any event the quenching gas or other fluid has sufficient heat capacity to rapidly solidify the fibers. Other fluids that may be used include water sprayed onto the fibers, e.g., heated water or steam to heat the fibers, and relatively cold water to quench the fibers.

Success in achieving the desired heat treatment and morphology of the amorphous-characterized phase often can be confirmed with DSC testing of representative fibers from a treated web; and treatment conditions can be adjusted according to information learned from the DSC testing, as discussed in greater detail in the above-mentioned application Ser. No. 11/457,899. Desirably the application of heated air and quenching are controlled so as to provide a web whose properties facilitate formation of an appropriate molded matrix. If inadequate heating is employed the web may be difficult to mold. If excessive heating or insufficient quenching are employed, the web may melt or become embrittled and also may not take adequate charge.

When a bimodal stiff filtration web is employed, the microfibers may for example have a size range of about 0.1 to about 10 μm, about 0.1 to about 5 μm or about 0.1 to about 1 μm. The larger size fibers may for example have a size range of about 10 to about 70 μm, about 10 to about 50 μm or about 15 to about 50 μm. A histogram of mass fraction vs. fiber size in μm may for example have a microfiber mode of about 0.1 to about 10 μm, about 0.5 to about 8 μm or about 1 to about 5 μm, and a larger size fiber mode of more than 10 μm, about 10 to about 50 μm, about 10 to about 40 μm or about 12 to about 30 μm. The disclosed bimodal webs may also have a bimodal fiber count/fiber size mixture whose histogram of fiber count (frequency) vs. fiber size in μm exhibits at least two modes whose corresponding fiber sizes differ by at least 50%, at least 100%, or at least 200% of the smaller fiber size. The microfibers may also for example provide at least 20% of the fibrous surface area of the web, at least 40% or at least 60%. When a web of partially crystalline and partially amorphous oriented meltspun fibers is employed, the fibers may for example have a size range of about 5 to about 70 μm, about 10 to about 50 μm or about 10 to about 30 μm as measured using optical microscopy. Larger meltspun fibers generally yield stiffer finished webs.

Depending on the process and process conditions used to make the disclosed stiff filtration web, some bonding may occur between the fibers during web formation, and thus the completed web may contain fibers bonded to one another at least some points of fiber intersection. Further bonding between fibers in the collected web may be needed to provide a web having the desired degree of stiffness. However, excessive bonding may also need to be avoided so as to limit pressure drop or other finished web or respirator properties.

After formation, the stiff filtration web is next subjected to charging and optional calendering. Although charging and calendering may be performed in either order, charging desirably is performed first so that charge will be distributed throughout the web thickness. Charge can be imparted to the disclosed nonwoven webs in a variety of ways. Charging may be carried out, for example, by contacting the web with water as disclosed in U.S. Pat. No. 5,496,507 (Angadjivand et al. '507), corona-treating as disclosed in U.S. Pat. No. 4,588,537 (Klasse et al.), hydrocharging as disclosed, for example, in U.S. Pat. No. 5,908,598 (Rousseau et al.), plasma treating as disclosed in U.S. Pat. No. 6,562,112 B2 (Jones et al.) and U.S. Patent Application Publication No. US2003/0134515 A1 (David et al.), or combinations thereof.

Calendering may be performed in a variety of ways that will be familiar to persons having ordinary skill in the art. Calendering usually is performed using heating and optional pressure (e.g., to a temperature between the applicable polymer softening point and melting point at the applicable pressure) and a point-bonding process or smooth calender rolls. Roll calendering is especially useful and may be performed in a variety of ways. For example, the web may be passed one or more times between two mating heated metal rolls to provide a calendered web having two smooth sides. The web may also be passed one or more times between a heated metal roll and mating resilient roll to provide a calendered web having one smooth side. Use of tighter roll gaps, greater nip pressures, higher temperatures or additional passes generally will increase the extent to which the web is stiffened. However calendering, if carried out to too great an extent, may undesirably increase pressure drop or compromise filtration performance in the completed respirator. Calendering typically also will cause the calendered surface to become denser and less porous. Calendaring one or both sides of the stiff filtration layer may discourage shedding sufficiently so that one or both cover webs will not be needed in the finished respirator. Accordingly, a calendered stiff filtration web provides particular advantages in that it may enable elimination of a stiffening layer and one or both covers layer in the completed respirator, thereby eliminating one to three of the layers in a conventional four layer construction.

The disclosed stiff filtration web may be formed in a variety of other ways. For example, the stiff filtration web may include a permeable skin layer or layers formed by melting fibers at and immediately adjacent one or both major surfaces of a nonwoven web, like those shown in U.S. Pat. Nos. 6,217,691 B1 and 6,358,592 B2 (both to Vair et al.).

The completed respirator optionally may include an inner cover web of lightweight construction. The inner cover web presents a smooth surface opposite the wearer's face and can increase respirator comfort. An outer cover web may also be employed if desired. As mentioned above, the inner or outer or both inner and outer cover webs preferably are rendered unnecessary through the use of a suitably calendered stiff filtration web. The inner and outer cover webs may have any suitable construction and composition. For example, the inner and outer cover webs may be spunbond webs, or smooth BMF webs made as described in U.S. Pat. No. 6,041,782 (Angadjivand et al. '782). In order to improve recyclability, the inner and outer cover webs desirably have the same polymeric composition as the stiff filtration web. The respirator may if desired include one or more additional layers other than those discussed above. For example, one or more porous layers containing sorbent particles may be employed to capture vapors of interest, such as the porous layers described in U.S. patent application Ser. No. 11/431,152 filed May 8, 2006 and entitled PARTICLE-CONTAINING FIBROUS WEB, the entire disclosure of which is incorporated herein by reference.

During formation of the disclosed stiff filtration web it typically will be helpful to monitor web properties such as basis weight, web thickness, solidity and Gurley Stiffness. It may also be helpful to monitor additional web properties such as EFD and Taber Stiffness, or completed respirator properties such as pressure drop, initial % NaCl penetration, % DOP penetration or the Quality Factor QF. When exposed to a 1 wt. % sodium chloride aerosol flowing at 95 liters/min, the completed respirator may for example have no more than 20% maximum NaCl penetration. In another embodiment the respirator, if exposed to a 0.075 μm 2% sodium chloride aerosol flowing at 85 liters/min, may have a pressure drop less than 20 mm $H_2O$ or less than 10 mm $H_2O$, and may have a % maximum NaCl loading penetration less than about 5% or less than about 1%.

Basis weight may be determined gravimetrically using samples taken from several (e.g., 3 or more) evenly-space locations across the web widthwise direction. Similar sampling may be used to determine web thickness. Solidity may be calculated from the basis weight and web thickness measurements.

Gurley Stiffness may be determined using a Model 4171E GURLEY™ Bending Resistance Tester from Gurley Precision Instruments. Rectangular samples (3.8 cm×5.1 cm unless otherwise indicated) are die cut from the webs with the sample long side aligned with the web transverse (cross-web) direction. The samples are loaded into the Bending Resistance Tester with the sample long side in the web holding clamp. The samples are flexed in both directions, viz., with the test arm pressed against the first major sample face and then against the second major sample face, and the average of the two measurements is recorded as the stiffness in milligrams. The test is treated as a destructive test and if further measurements are needed fresh samples are employed.

EFD may be determined (unless otherwise specified) using an air flow rate of 32 L/min (corresponding to a face velocity of 5.3 cm/sec), using the method set forth in Davies, C. N., "The Separation of Airborne Dust and Particles", Institution of Mechanical Engineers, London, Proceedings 1B, 1952.

Taber Stiffness may be determined using a Model 150-B TABER™ stiffness tester (commercially available from Taber Industries). Square 3.8 cm×3.8 cm sections are carefully vivisected from the webs using a sharp razor blade to prevent fiber fusion, and evaluated to determine their stiffness in the machine and transverse directions using 3 to 4 samples and a 15° sample deflection.

Pressure drop, percent penetration and the filtration Quality Factor QF may be determined using a challenge aerosol containing NaCl or DOP particles, delivered (unless otherwise indicated) at a flow rate of 95 or 85 liters/min, and evaluated using a TSI™ Model 8130 high-speed automated filter tester (commercially available from TSI Inc.). An MKS pressure transducer (commercially available from MKS Instruments) may be employed to measure pressure drop ($\Delta P$, mm $H_2O$) through the filter. For NaCl testing at 95 liters/min, the particles may generated from a 1% NaCl solution, and the Automated Filter Tester may be operated with both the heater and particle neutralizer on. For NaCl testing at 85 liters/min and using 0.075 μm diameter particles, the particles may be generated from a 2% NaCl solution to provide an aerosol containing particles at an airborne concentration of about 16-23 mg/m$^3$, and the Automated Filter Tester may be operated with both the heater and particle neutralizer on. For DOP testing, the aerosol may contain particles with a diameter of about 0.185 μm at a concentration of about 100 mg/m$^3$, and the Automated Filter Tester may be operated with both the heater and particle neutralizer off. The samples may be loaded to the maximum NaCl or DOP particle penetration and calibrated photometers may be employed at the filter inlet and outlet to measure the particle concentration and the % particle penetration through the filter. The equation:

$$QF = \frac{-\ln\left(\frac{\%\ \text{Particle Penetration}}{100}\right)}{\Delta P}$$

may be used to calculate QF. Parameters which may be measured or calculated for the chosen challenge aerosol include initial particle penetration, initial pressure drop, initial Quality Factor QF, maximum particle penetration, pressure drop at maximum penetration, and the milligrams of particle loading at maximum penetration (the total weight challenge to the filter up to the time of maximum penetration). The initial Quality Factor QF value usually provides a reliable indicator of overall performance, with higher initial QF values indicating better filtration performance and lower initial QF values indicating reduced filtration performance.

The invention is further illustrated in the following illustrative examples, in which all parts and percentages are by weight unless otherwise indicated.

EXAMPLE 1

Using an apparatus like that shown in FIG. 7 and FIG. 8 and procedures like those described in Wente, Van A. "superfine Thermoplastic Fiber", Industrial and Engineering Chemistry, vol. 48. No. 8, 1956, pp 1342-1346 and Naval Research Laboratory Report 111437, Apr. 15, 1954, a meltblown monocomponent monolayer web was formed from larger fibers and smaller size fibers of the same polymeric composition. The larger size fibers were formed using TOTAL 3960 polypropylene (a 350 melt flow rate polymer) to which had been added 0.8% CHIMASSORB 944 hindered amine light stabilizer as an electret charging additive and 1% POLYONE™ No. CC10054018WE blue pigment from PolyOne Corp. to aid in assessing the distribution of larger size fibers in the web. The resulting blue polymer blend was fed to a Model 20 DAVIS STANDARD™ 2 in. (50.8 mm) single screw extruder from the Davis Standard Division of Crompton & Knowles Corp. The extruder had a 60 in. (152 cm) length and a 30/1 length/diameter ratio. The smaller size fibers were formed using EXXON PP3746 polypropylene (a 1475 melt flow rate polymer) available from Exxon Mobil Corporation to which had been added 0.8% CHIMASSORB 944 hindered amine light stabilizer. This latter polymer was white in color and was fed to a KILLION™ 0.75 in. (19 mm) single screw extruder from the Davis Standard Division of Crompton & Knowles Corp. Using 10 cc/rev ZENITH™ melt pumps from Zenith Pumps, the flow of each polymer was metered to separate die cavities in a 20 in. (50.8 cm) wide drilled orifice meltblowing die employing 0.015 in. (0.38 mm) diameter orifices at a spacing of 25 holes/in. (10 holes/cm) with alternating orifices being fed by each die cavity. Heated air attenuated the fibers at the die tip. The airknife employed a 0.010 in. (0.25 mm) positive set back and a 0.030 in. (0.76 mm) air gap. A moderate vacuum was pulled through a medium mesh collector screen at the point of web formation, and a 22.5 in. (57.2 cm) DCD (die-to-collector distance) was employed. By adjusting the polymer rate from each extruder webs with 75% larger size fibers and 25% smaller size fibers were produced. The collector speed was adjusted as needed to provide webs with about 200 gsm basis weight. The extrusion temperatures and the pressure of the heated air were adjusted as needed to provide webs with about 20 μm EFD value. The web was hydrocharged with distilled water according to the technique taught in U.S. Pat. No. 5,496,507 (Angadjivand et al. '507) and allowed to dry, then calendered between smooth steel rolls which had been heated to 140° C., gapped to 0.76 mm and operated at 3.05 m/min. Set out below in Table 1A are the run number, basis weight, EFD and Gurley Stiffness for the calendered filtration web.

TABLE 1A

| Run No. | Basis Weight, gsm | EFD, μm | Gurley Stiffness, mg |
|---|---|---|---|
| 1-1F | 208 | 20.3 | 889 |

The calendered filtration web was combined with a 17 gsm spunbond polypropylene inner cover web and a 17 gsm spunbond polypropylene outer cover web in an apparatus like that shown in FIG. 3 and made into flat-fold respirators like the device shown in FIG. 1 and FIG. 2. The completed respirators were folded and unfolded and found to have both good storage properties when folded flat, and a comfortable fit and desirable off-the-face configuration when worn. The initial NaCl particle penetration for the inventive respirator and a comparison four-layer flat fold respirator made using separate filtration and stiffening layers were also evaluated. Set out below in Table 1B are the run number, respirator identity, initial pressure drop and initial NaCl penetration using a 0.075 μm diameter NaCl particle aerosol flowing at 85 liters/min.

TABLE 1B

| Run No. | Respirator Identity | Initial Pressure Drop, mm $H_2O$ | Initial Penetration, % |
|---|---|---|---|
| 1-1R | 3-layer Respirator Made From Web 1-1F | 6.8 | 1.19 |
| 1-1C | Comparison 4-layer Respirator | 10 | 8.01 |

The data in Table 1B shows that the Run No. 1-1R respirator had lower initial pressure drop and lower initial NaCl penetration than the comparison 4-layer respirator.

EXAMPLE 2

Using the method of Example 1, a meltblown monocomponent monolayer web was formed from larger fibers and smaller size fibers of the same polymeric composition. The larger size fibers were formed using EXXON PP3155 polypropylene (a 36 melt flow rate polymer) available from Exxon Mobil Corporation to which had been added 0.8% CHIMASSORB 944 hindered amine light stabilizer as an electret charging additive and 2% POLYONE No. CC10054018WE blue pigment. The resulting blue polymer blend was fed to a Model 20 DAVIS STANDARD extruder like that used in Example 1. The smaller size fibers were formed using EXXON PP3746 polypropylene to which had been added 0.8% CHIMASSORB 944 hindered amine light stabilizer and 2% POLYONE No. CC10054018WE blue pigment. This latter polymer was fed to a KILLION extruder like that used in Example 1. By using a 13.5 in. (34.3 cm) DCD and adjusting the polymer rate from each extruder, webs with 65% larger size fibers and 35% smaller size fibers were produced. The collector speed was adjusted as needed to provide webs with about 200 to about 250 gsm basis weights, and the extrusion temperatures and heated air pressures were adjusted as needed to provide webs with about 16 to about 18 μm EFD values. The webs were hydrocharged with distilled water according to the technique taught in Angadjivand et al. '507 and allowed to dry. The resulting webs were made into flat fold respirators like the device shown in FIG. 1 and FIG. 2 and evaluated using a 0.075 μm diameter NaCl particle aerosol flowing at 85 liters/min. Set out below in Table 2A are the run number; the basis weight, EFD, thickness and Gurley Stiffness for the calendered filtration webs; and the initial pressure drop and initial NaCl penetration for the finished respirators.

TABLE 2A

| Run No. | Basis Weight, gsm | EFD, μm | Thickness, mm | Gurley Stiffness, mg | Initial Pressure Drop, mm $H_2O$ | Initial Penetration, % |
|---|---|---|---|---|---|---|
| 2-1 | 202 | 16.8 | 0.325 | 1012 | 3.8 | 3.45 |
| 2-2 | 224 | 16.7 | 0.394 | 991 | 3.8 | 3.46 |
| 2-3 | 251 | 16.3 | 0.470 | 1315 | 4.6 | 2.75 |
| 2-4 | 206 | 17.0 | 0.325 | 1350 | 3.2 | 4.96 |
| 2-5 | 226 | 18.3 | 0.345 | 1325 | 3.5 | 4.45 |
| 2-6 | 248 | 18.4 | 0.378 | 1623 | 4.5 | 2.93 |

The results in Table 2A show that each respirator should meet European FFP1 filtering facepiece requirements (see EN149:2001, Respiratory protective devices. Filtering half masks to protect against particles).

EXAMPLE 3

Using an apparatus like that shown in FIG. 9 and FIG. 10 and procedures like those described in Wente, Van A. "superfine Thermoplastic Fiber", Industrial and Engineering Chemistry, vol. 48. No. 8, 1956, pp 1342-1346 and Naval Research Laboratory Report 111437, Apr. 15, 1954, four monocomponent monolayer meltblown webs were formed from TOTAL 3960 polypropylene to which had been added 0.8% tristearyl melamine as an electret charging additive. The polymer was fed to a Model 20 DAVIS STANDARD 2 in. (50.8 mm) single screw extruder with a 20/1 length/diameter ratio and a 3/1 compression ratio. A ZENITH 10 cc/rev melt pump metered the flow of polymer to a 10 in. (25.4 cm) wide drilled orifice meltblowing die whose original 0.012 in. (0.3 mm) orifices had been modified by drilling out every 9th orifice to 0.025 in. (0.6 mm), thereby providing a 9:1 ratio of the number of smaller size to larger size holes and a 60:40 ratio of larger hole size to smaller hole size. The line of orifices had 25 holes/inch (10 holes/cm) hole spacing. Heated air attenuated the fibers at the die tip. The airknife employed a 0.010 in. (0.25 mm) positive set back and a 0.030 in. (0.76 mm) air gap. No to moderate vacuum was pulled through a medium mesh collector screen at the point of web formation. The polymer output rate from the extruder was varied as needed from a 2.0 lbs/in/hr (0.36 kg/cm/hr) starting point, the DCD was varied from 11.50 to 16.25 in. (29.21 cm to 41.725 cm) and the air pressure was adjusted as needed to provide webs with a basis weight and EFD as shown below in Table 3A. The webs were hydrocharged with distilled water according to the technique taught in Angadjivand et al. '507 and allowed to dry. Set out below in Table 3A are the Sample Number, basis weight, EFD, web thickness, initial pressure drop, initial NaCl penetration and Quality Factor QF for each web at a 13.8 cm/sec face velocity.

TABLE 3A

| Sample No. | Basis Weight, gsm | EFD, μm | Pressure Drop, mm $H_2O$ | Initial Penetration, % | Quality Factor QF, 1/mm $H_2O$ |
|---|---|---|---|---|---|
| 3-1 | 173 | 13 | 5.10 | 0.71 | 0.97 |
| 3-2 | 200 | 13 | 6.40 | 0.54 | 0.81 |

TABLE 3A-continued

| Sample No. | Basis Weight, gsm | EFD, μm | Pressure Drop, mm $H_2O$ | Initial Penetration, % | Quality Factor QF, 1/mm $H_2O$ |
|---|---|---|---|---|---|
| 3-3 | 222 | 13 | 6.80 | 0.44 | 0.80 |
| 3-4 | 254 | 13 | 7.10 | 0.21 | 0.87 |
| 3-5 | 175 | 15 | 4.40 | 1.44 | 0.96 |
| 3-6 | 197 | 15 | 5.00 | 0.97 | 0.93 |
| 3-7 | 229 | 15 | 5.60 | 0.95 | 0.83 |
| 3-8 | 243 | 15 | 6.20 | 0.53 | 0.84 |

The webs were next lightly calendered for one or two passes between rolls heated to 141° C. and operating at a 3.05 m/min line speed. Calendering gaps of about 1.5 to 2.2 mm were employed. The calendering gaps and web thicknesses for each sample are shown below in Table 3B:

TABLE 3B

| | Calender | Thickness, mm | | |
|---|---|---|---|---|
| Sample No. | Gap, mm | Uncalendered | Calendered Once | Calendered Twice |
| 3-1 | 1.5 | 3.02 | 2.69 | 2.72 |
| 3-2 | 1.8 | 3.66 | 2.90 | 3.25 |
| 3-3 | 1.9 | 3.91 | 3.58 | 3.71 |
| 3-4 | 2.2 | 4.34 | 3.89 | 4.01 |
| 3-5 | 1.5 | 2.82 | 2.59 | 2.54 |
| 3-6 | 1.8 | 3.12 | 2.79 | 2.69 |
| 3-7 | 1.9 | 3.73 | 3.40 | 3.23 |
| 3-8 | 2.2 | 4.06 | 3.48 | 3.40 |

The Gurley Stiffness values (measured using 25.4×38.1 mm samples) and pressure drop values (measured using a 32 l/min flow rate) for each sample are shown below in Table 3C:

TABLE 3C

| | Gurley Stiffness, mg | | | Pressure Drop, mm $H_2O$ | | |
|---|---|---|---|---|---|---|
| Sample No. | Uncalendered | Calendered Once | Calendered Twice | Uncalendered | Calendered Once | Calendered Twice |
| 3-1 | 365 | 410 | 411 | 1.76 | 1.84 | 1.99 |
| 3-2 | 479 | 464 | 458 | 2.08 | 2.09 | 2.12 |
| 3-3 | 595 | 538 | 496 | 2.33 | 2.4 | 2.59 |
| 3-4 | 700 | 693 | 655 | 2.6 | 2.84 | 2.86 |
| 3-5 | 486 | 513 | 540 | 1.45 | 1.59 | 1.54 |
| 3-6 | 633 | 560 | 633 | 1.55 | 1.73 | 1.70 |
| 3-7 | 718 | 742 | 816 | 1.9 | 1.78 | 1.92 |
| 3-8 | 900 | 835 | 896 | 1.95 | 2.02 | 2.12 |

The results in Table 3C show, inter alia, that pressure drop was not significantly adversely affected by calendering. The webs were made into flat fold respirators like the device shown in FIG. 1 and FIG. 2 and evaluated using a 0.075 μm diameter NaCl particle aerosol flowing at 85 liters/min. Respirators made using the uncalendered stiff filtration webs also employed inner and outer cover webs like those used in Example 2, and had a 3-layer construction. Respirators made using stiff filtration webs calendered on one side also employed an inner cover web like the web used in Example 2, and had a 2-layer construction. Respirators made using stiff filtration webs calendered on two sides employed no cover webs, and had a 1-layer construction. Set out below in Table 3D are the run number; percent penetration and Quality Factor QF for the finished respirators

TABLE 3D

| | % Penetration | | | Quality Factor, QF | | |
|---|---|---|---|---|---|---|
| Sample No. | Uncalendered | Calendered Once | Calendered Twice | Uncalendered | Calendered Once | Calendered Twice |
| 3-1 | 0.71 | 0.50 | 0.51 | 0.97 | 1.00 | 0.85 |
| 3-2 | 0.54 | 0.34 | 0.32 | 0.81 | 0.95 | 0.93 |
| 3-3 | 0.44 | 0.12 | 0.14 | 0.80 | 0.94 | 0.90 |
| 3-4 | 0.21 | 0.11 | 0.06 | 0.87 | 0.86 | 0.88 |
| 3-5 | 1.44 | 1.17 | 1.18 | 0.96 | 0.99 | 0.97 |
| 3-6 | 0.97 | 0.81 | 0.73 | 0.93 | 1.02 | 0.96 |
| 3-7 | 0.95 | 0.57 | 0.63 | 0.83 | 0.97 | 0.89 |
| 3-8 | 0.53 | 0.44 | 0.42 | 0.84 | 0.93 | 0.96 |

The results in Table 3D show, inter alia, that % penetration and the Quality factor QF were not significantly adversely affected by calendering.

Set out below in Table 3E are the run number, initial pressure drop, initial % penetration, pressure drop at maximum penetration, maximum % penetration, challenge at maximum penetration and total aerosol challenge for the 3-layer respirators made from the uncalendered web samples:

TABLE 3E

| Uncalendered Webs | | | | | | |
|---|---|---|---|---|---|---|
| Sample No. | Initial Pressure Drop, mm $H_2O$ | Initial Pen., % | Pressure Drop at Max. Pen., mm $H_2O$ | Max. Pen., % | Challenge at Max. Pen., mg | Total Aerosol Challenge, mg |
| 3-1 | 3.8 | 0.089 | 83.1 | 3.720 | 127.3 | 185.0 |
| 3-2 | 4.2 | 0.071 | 14.7 | 1.640 | 111.2 | 130.1 |
| 3-3 | 4.6 | 0.069 | 13.8 | 0.919 | 117.9 | 121.8 |
| 3-4 | 5.1 | 0.000 | 27.4 | 0.250 | 102.7 | 138.5 |
| 3-5 | 3.4 | 0.216 | 18.0 | 6.720 | 99.7 | 123.6 |
| 3-6 | 3.5 | 0.143 | 14.9 | 4.980 | 103.9 | 126.9 |
| 3-7 | 4.2 | 0.084 | 28.6 | 2.800 | 127.8 | 149.9 |
| 3-8 | 4.4 | 0.000 | 13.9 | 1.620 | 117.2 | 129.1 |

The results in Table 3E show that the 3-layer respirators made using the uncalendered webs of Sample Nos. 3-1 through 3-4, 3-7 and 3-8 should pass the N95 NaCl loading test of 42 C.F.R. Part 84.

Set out below in Table 3F are the run number, initial pressure drop, initial % penetration, pressure drop at maximum penetration, maximum % penetration, challenge at maximum penetration and total aerosol challenge for the 2-layer respirators made from the web samples which had been calendered on one side:

TABLE 3F

| Webs Calendered on One Side | | | | | | |
|---|---|---|---|---|---|---|
| Sample No. | Initial Pressure Drop, mm $H_2O$ | Initial Pen., % | Pressure Drop at Max. Pen., mm $H_2O$ | Max. Pen., % | Challenge at Max. Pen., mg | Total Aerosol Challenge, mg |
| 3-1 | 3.2 | 0.016 | 6.0 | 4.040 | 106.8 | 107.8 |
| 3-2 | 3.4 | 0.029 | 5.4 | 1.680 | 106.2 | 106.6 |
| 3-3 | 4.2 | 0.006 | 7.1 | 0.589 | 105.9 | 106.0 |
| 3-4 | 4.7 | 0.009 | 7.6 | 0.312 | 105.4 | 105.5 |
| 3-5 | 2.7 | 0.183 | 5.1 | 10.000 | 108.1 | 108.2 |
| 3-6 | 2.9 | 0.133 | 5.3 | 10.500 | 147.5 | 148.2 |
| 3-7 | 3.3 | 0.106 | 5.2 | 5.510 | 105.2 | 105.5 |
| 3-8 | 3.4 | 0.052 | 5.8 | 4.990 | 133.5 | 135.1 |

The results in Table 3F show that the 2-layer respirators made using the single-side calendered webs of Sample Nos. 3-1 through 3-4 and 3-8 should pass the N95 NaCl loading test of 42 C.F.R. Part 84.

Set out below in Table 3G are the run number, initial pressure drop, initial % penetration, pressure drop at maximum penetration, maximum % penetration, challenge at maximum penetration and total aerosol challenge for the 1-layer respirators made from the web samples which had been calendered on both sides:

TABLE 3G

| Webs Calendered on Both Sides | | | | | | |
|---|---|---|---|---|---|---|
| Sample No. | Initial Pressure Drop, mm $H_2O$ | Initial Pen., % | Pressure Drop at Max. Pen., mm $H_2O$ | Max. Pen., % | Challenge at Max. Pen., mg | Total Aerosol Challenge, mg |
| 3-1 | 2.8 | 0.484 | 6.7 | 4.670 | 114.9 | 115.0 |
| 3-2 | 3.1 | 0.016 | 5.2 | 2.100 | 106.7 | 107.1 |
| 3-3 | 3.8 | 0.012 | 7.3 | 0.736 | 119.1 | 121.6 |
| 3-4 | 4.2 | 0.000 | 6.9 | 0.253 | 103.6 | 103.6 |
| 3-5 | 2.2 | 0.216 | 4.4 | 12.500 | 120.4 | 123.2 |
| 3-6 | 2.5 | 0.111 | 7.4 | 10.700 | 160.1 | 201.0 |
| 3-7 | 3.0 | 0.153 | 4.9 | 4.920 | 105.1 | 106.2 |
| 3-8 | 3.1 | 0.064 | 7.2 | 6.410 | 198.2 | 211.0 |

The results in Table 3G show that the 2-layer respirators made using webs of Sample Nos. 3-1 through 3-4 and 3-7 calendered on both sides should pass the N95 NaCl loading test of 42 C.F.R. Part 84.

EXAMPLE 4

Using an apparatus like that shown in FIG. 11 through FIG. 13, a monocomponent monolayer web (web 4-1) was formed from FINA 3860 polypropylene having a melt flow rate index of 70 available from Total Petrochemicals. The extrusion head 10 had 488 holes of 0.5 mm (0.020 in) diameter arranged in a staggered 203 mm (8 in) wide pattern. The polymer was fed to the extrusion head at 0.2 g/hole/minute, where the polymer was heated to a temperature of 205° C. (401° F.). Two quenching air streams (318*b* in FIG. 11; stream 318*a* was not employed) were supplied as an upper stream from quench boxes 406 mm (16 in) in height at an approximate face velocity of 0.37 m/sec (73 ft/min) and a temperature of 1.7° C. (35° F.), and as a lower stream from quench boxes 197 mm (7.75 in) in height at an approximate face velocity of face velocity of 0.11 m/sec (22 ft/min) and ambient room temperature. A movable-wall attenuator like that shown in Berrigan et al. was employed, using an air knife gap (30 in Berrigan et al.) of 0.76 mm (0.030 in), air fed to the air knife at a pressure of 0.096 MPa (14 psig), an attenuator top gap width of 5.1 mm (0.20 in), an attenuator bottom gap width of 4.7 mm (0.185 in), and 152 mm (6 in) long attenuator sides (36 in Berrigan et al.). The distance (317 in FIG. 11) from the extrusion head 310 to the attenuator 316 was 78.7 cm (31 in), and the distance (321 in FIG. 11) from the attenuator 316 to the collection belt 319 was 68.6 cm (27 in). The meltspun fiber stream was deposited on the collection belt 319 at a width of about 51 cm (about 20 in). Collection belt 319 moved at a rate of about 1.8 meters/min (6 ft/min). The vacuum under collection belt 319 was estimated to be in the range of about 1.5-3.0 KPa (6-12 in. $H_2O$). The region 415 of the plate 411 had 1.6 mm (0.062-inch-diameter) openings in a staggered spacing resulting in 23% open area; the web hold-down region 416 had 1.6 mm (0.062-inch) diameter openings in a staggered spacing resulting in 30% open area; and the heating/bonding region 417 and the quenching region 418 had 4.0 mm (0.156-inch) diameter openings in a staggered spacing resulting in 63% open area. Air was supplied through the conduits 407 at a rate sufficient to present about 14.2 $m^3$/min (about 500 $ft.^3$/min) of air at the slot 409, which was 3.8 by 85.3 cm (1.5 in. by 26 in). The bottom of the plate 408 was 3.175 cm (1.25 in) from the collected web 320 on collector 319. The temperature of the air passing through the slot 409 of the quenched flow heater was 157° C. (315° F.) as measured at the entry point for the heated air into the housing 401.

The web leaving the quenching area 420 was bonded with sufficient integrity to be self-supporting and handleable using normal processes and equipment; the web could be wound by normal windup into a storage roll or could be subjected to various operations such as heating and compressing the web over a hemispherical mold to form a molded respirator. The web was hydrocharged with distilled water according to the technique taught in Angadjivand et al. '507, and allowed to dry.

A second monocomponent monolayer web (web 4-2) was similarly made from FINA 3860 polypropylene to which had been added 0.5 wt. % of CHIMASSORB 944 hindered-amine light stabilizer from Ciba Specialty Chemicals. The conditions were the same as for web 4-1 except that extrusion head 10 had 512 holes arranged in a 10 cm (4 in) by 20 cm (8 in) pattern with 0.64 cm (0.25 in) hole spacing and with the long dimension of the pattern arranged across the web. The upper quench stream had an approximate face velocity of 0.32 m/sec (63 ft/min). The attenuator bottom gap width was 4.8 mm (0.19 in). The meltspun fiber stream was deposited on the collection belt 319 at a width of about 46 cm (about 18 in). Collection belt 319 moved at a rate of about 1.77 meters/min (5.8 ft/min). The bottom of the plate 408 was 4.1 cm (1.6 in) from the collected web 320 on collector 319. The collected web was hydrocharged with distilled water according to the technique taught in Rousseau et al. and allowed to dry.

The charged webs were evaluated to determine the flat web properties shown below in Table 4A:

TABLE 4A

| Property | Web No. 4-1 | Web No. 4-2 |
|---|---|---|
| Basis weight, gsm | 125 | 128 |
| EFD, μm | 12.4 | 12 |
| Gurley Stiffness, mg | 1181 | 405 |
| DOP Penetration at 14 cm/sec face velocity, % | 18 | 2 |
| Quality Factor, QF, at 14 cm/sec face velocity, % | 0.31 | 0.69 |

The webs were made into flat fold respirators like the device shown in FIG. 1 and FIG. 2 and evaluated using a 0.075 μm diameter NaCl particle aerosol flowing at 85 liters/min. The results are shown below in Table 4B:

TABLE 4B

| Property | Web No. 4-1 | Web No. 4-2 |
|---|---|---|
| Initial Pressure Drop, mm $H_2O$ | 4.0 | 4.7 |
| Initial Penetration, % | 2.1 | 0.37 |
| Max. Penetration, % | 10.2 | 12.6 |
| Challenge at Max. Penetration, mg | 47 | 58 |

A number of embodiments of the invention have been described. Nevertheless, it will be understood that various modifications may be made without departing from the invention. Accordingly, other embodiments are within the scope of the following claims.

We claim:

1. A flat-fold personal respirator that comprises at least one stiff filtration panel joined to the remainder of the respirator through at least one line of demarcation, the panel comprising a porous monocomponent monolayer nonwoven web that contains charged intermingled continuous monocomponent polymeric fibers of the same polymeric composition, wherein the nonwoven web further contains crystalline and amorphous phases in oriented meltspun fibers, wherein the porous monocomponent monolayer nonwoven web has sufficient basis weight or inter-fiber bonding so that the web exhibits a Gurley Stiffness greater than 200 mg, and wherein the respirator exhibits less than 20 mm $H_2O$ pressure drop.

2. A respirator according to claim 1 wherein the nonwoven web contains a bimodal mass fraction/fiber size mixture of intermingled continuous monocomponent polymeric microfibers and larger size fibers.

3. A respirator according to claim 1 wherein the nonwoven web has a basis weight of about 100 to about 500 gsm.

4. A respirator according to claim 1 wherein the nonwoven web has a basis weight of about 150 to about 250 gsm.

5. A respirator according to claim 1 wherein the nonwoven web is calendered.

6. A respirator according to claim 1 wherein the nonwoven web has a Gurley Stiffness of at least about 300 mg.

7. A respirator according to claim 1 further comprising an inner cover web.

8. A respirator according to claim 7 wherein the inner cover web and stiff filtration panel have the same polymeric composition.

9. A respirator according to claim 1 wherein the polymer is polypropylene.

10. A respirator according to claim 1 wherein the polymer is poly-4-methyl-1 pentene.

11. A respirator according to claim 1 which exhibits no more than 20% maximum penetration when exposed to 1 wt. % sodium chloride aerosol flowing at 95 liters/min.

12. A respirator according to claim 1 which exhibits less than 5% maximum loading penetration when exposed to a 0.075 μm 2% sodium chloride aerosol flowing at 85 liters/min.

13. A respirator according to claim 1 which exhibits less than 1% maximum loading penetration when exposed to a 0.075 μm 2% sodium chloride aerosol flowing at 85 liters/min.

14. A respirator according to claim 1 comprising a non-pleated main body comprising:

a first portion;

a second portion distinguished from the first portion by a first line of demarcation;

a third portion distinguished from the second portion by a second line of demarcation; and a bisecting fold that is substantially vertical and extends through the first portion, second portion and third portion when viewed from the front while the respirator is oriented as in use on a wearer;

wherein the first, second and third portions are each divided into left and right panels which each comprise the stiff filtration panel and the respirator is capable of being folded to a substantially flat-folded configuration along the bisecting fold.

15. A respirator according to claim 14 further comprising an inner cover web having the same polymeric composition as the stiff filtration panel.

16. A respirator according to claim 1 comprising a filtration structure comprising an optional inner cover web, a filtration layer comprising a web containing charged microfibers, and an optional outer cover web, the optional inner and optional outer cover webs being disposed on first and second opposing sides of the filtration layer, respectively; the filtration structure being divided into upper, central and lower filtration panels, the central panel being separated from the upper and lower panels by first and second lines of demarcation;

wherein at least the central panel comprises the stiff filtration panel such that the filtration layer of the central panel comprises the porous monocomponent monolayer nonwoven web, and wherein the respirator is capable of being folded to a substantially flat-folded configuration along the first and second lines of demarcation.

17. A respirator according to claim 16 wherein the inner cover web has the same polymeric composition as the stiff filtration panel.

18. A respirator according to claim 16 wherein at least one of the first or second lines of demarcation is curvilinear.

19. A respirator according to claim 1 comprising a filtration body comprising an optional inner cover web, a filtration layer comprising a web containing charged microfibers and an optional outer cover web, the filtration body having a central portion between first and second portions, the central portion comprising the stiff filtration panel such that the filtration layer of the central portion comprises the porous monocomponent monolayer nonwoven web, wherein the central portion is defined by first and second lines of demarcation and has a width of about 160 to 220 mm and a height of about 30 to 110 mm, the respirator being capable of being folded flat for storage with the first portion in at least partial face-to-face contact with a surface of the central portion and the second portion in contact with a surface of the first portion, and the respirator when unfolded for use forming a cup-shaped off-the-face air chamber over the nose and mouth of a wearer.

* * * * *